US011654469B2

(12) United States Patent
Lekkakis

(10) Patent No.: US 11,654,469 B2
(45) Date of Patent: May 23, 2023

(54) DEVICE FOR THE PRODUCTION OF APPROPRIATELY CONFIGURED ROLL ASSEMBLIES OF EXPANDED ALUMINIUM MESH ADAPTED TO EFFICIENTLY FILL FUEL CONTAINERS

(71) Applicant: Petros Lekkakis, Attikis (GR)

(72) Inventor: Pavlos Lekkakis, Attikis (GR)

( * ) Notice: Subject to any disclaimer, the term of this patent is extended or adjusted under 35 U.S.C. 154(b) by 814 days.

(21) Appl. No.: 16/603,540

(22) PCT Filed: Apr. 7, 2017

(86) PCT No.: PCT/GR2017/000018
§ 371 (c)(1),
(2) Date: Oct. 7, 2019

(87) PCT Pub. No.: WO2018/185505
PCT Pub. Date: Oct. 11, 2018

(65) Prior Publication Data

US 2021/0086247 A1 Mar. 25, 2021

(51) Int. Cl.
*B21D 11/06* (2006.01)
*A62C 3/06* (2006.01)
(Continued)

(52) U.S. Cl.
CPC ..... *B21D 11/06* (2013.01); *A62C 3/065* (2013.01); *B21D 31/04* (2013.01);
(Continued)

(58) Field of Classification Search
CPC ..... B21D 11/06; B21D 31/04; A62C 3/065; B60K 15/03; B60K 2015/03381;
(Continued)

(56) References Cited

U.S. PATENT DOCUMENTS 3,470,592 A * 10/1969 Robertson ..... B65H 23/02 26/104
3,766,855 A * 10/1973 Hardt ..... B41F 13/02 101/248
(Continued)

FOREIGN PATENT DOCUMENTS

DE 197 56 807 A1 7/1999
EP 0 912 267 B1 5/1999
(Continued)

*Primary Examiner* — Leslie A Nicholson, III
(74) *Attorney, Agent, or Firm* — Nguyen Tarbet LLC

(57) ABSTRACT

Device for the production of selectively configured roll assemblies of expanded aluminium mesh (17) adapted to efficiently fill fuel containers and provide suppression of ignition and combustion of the fuel contained therein, comprising a roll (1) of in expanded aluminium mesh at an inlet of the device, a mechanism (5) for providing tensioning of a mesh web (15) flowing from the inlet to the outlet of the device, a mechanism (6) for forwardly moving mesh web (15), a mechanism (7) for transversely cutting a predetermined portion of mesh web (15), a mechanism (8) that securely folds the edge of the transversely cut end of mesh web (15) and a mechanism (10) wherein a mesh roll assembly (16) is set up onto a disc (12*c*) that rotates to wind a predetermined number of turns of mesh web (15) around mesh roll assembly (16) and provide an end product of roll assembly of expanded aluminium mesh (17).

10 Claims, 18 Drawing Sheets

(51) Int. Cl.

| | |
|---|---|
| ***B21D 31/04*** | (2006.01) |
| ***B65H 18/02*** | (2006.01) |
| ***B65H 20/02*** | (2006.01) |
| ***B65H 23/02*** | (2006.01) |
| ***B65H 45/10*** | (2006.01) |
| ***B65H 45/28*** | (2006.01) |
| ***B65H 75/22*** | (2006.01) |

(52) U.S. Cl.
CPC ..... *B65H 18/0212* (2020.08); *B65H 20/02* (2013.01); *B65H 23/02* (2013.01); *B65H 45/10* (2013.01); *B65H 45/28* (2013.01); *B65H 75/22* (2013.01)

(58) Field of Classification Search
CPC .... B65H 18/0212; B65H 20/02; B65H 23/02; B65H 45/10; B65H 45/28; B65H 75/22; B65H 35/06
See application file for complete search history.

(56) References Cited

U.S. PATENT DOCUMENTS

| | | | | |
|---|---|---|---|---|
| 6,609,279 | B2 * | 8/2003 | Kogler | B21D 31/04 29/6.1 |
| 8,523,034 | B2 * | 9/2013 | Fuchs | G03G 15/652 226/118.4 |
| 9,896,298 | B2 * | 2/2018 | Yoshida | B26D 7/08 |
| 11,319,179 | B2 * | 5/2022 | Nagai | D21F 9/00 |
| 2008/0263841 | A1 * | 10/2008 | Stelzl | B23K 26/0846 29/6.1 |

FOREIGN PATENT DOCUMENTS

| | | | | |
|---|---|---|---|---|
| EP | 1 183 115 | B1 | | 3/2002 |
| EP | 2 251 113 | B1 | | 11/2010 |
| GR | 1004528 | B | * | 5/2004 |
| GR | 20120100644 | A | * | 7/2014 |
| WO | 2008/122826 | A1 | | 10/2008 |

* cited by examiner

DEVICE FOR THE PRODUCTION OF APPROPRIATELY CONFIGURED ROLL ASSEMBLIES OF EXPANDED ALUMINIUM MESH ADAPTED TO EFFICIENTLY FILL FUEL CONTAINERS

THE FIELD OF THE ART

The invention relates to the field of production of aluminum mesh that is manufactured from an aluminum foil, which is provided with a plurality of equally sized apertures arranged along the longitudinal axis of the foil and is subsequently expanded laterally to produce rolls of expanded aluminum mesh adapted to fill fuel tanks and provide suppression of ignition and combustion of the fuel contained therein.

THE BACKGROUND OF THE INVENTION

Safety problems are encountered with the processing, storage and transport of fuels of various kinds, such problems arising from risks of fire and explosions, as well as from the inherently environmentally hazardous evaporation of liquid fuels. Fuel processing plants comprising a plurality of fuel tanks are particularly vulnerable to such risks. A major threat is also present in the transport of combustible substances contained in trucks carrying tanks filled with such substances.

Greek Patent Certificate 0.1004528 disclosed a machine for the production of a roll of an expanded aluminum mesh adapted to fill fuel tanks and provide suppression of ignition and combustion of the fuel contained therein. A second unreeling-rereeling machine was disclosed in Greek Patent Certificate 1005763, this machine being employed to produce rolls of specific diameters from the rolls of GR-1004528 and attach an angular plate along a transverse edge at the end of each roll to avert fraying and deterioration of the expanded mesh. A further Greek patent certificate GR20120100644 proposes an anti-fraying plate supersonically welded along a transverse edge of the expanded aluminium mesh.

The aforementioned product of expanded aluminum mesh rolls has been successfully tested in fuel tanks which are filled with such roles and subjected to conditions that would otherwise cause the ignition and explosion of fuel and have under such conditions demonstrated adequacy of the product to provide suppression of ignition and combustion of fuel that would inevitably lead into seriously catastrophic consequences. This advantageous capacity of the product of expanded aluminium mesh rolls is due to the structure thereof that is formed by laterally stretching an aluminium sheet having a plurality of slits cut therein, the slits being oriented parallel to the longitudinal axis of the aluminium sheet. The product works through the effected separation of flame arising within a fuel tank into a plurality of minute burning loci corresponding to the plurality of slits of the mesh thereby substantially reducing the flame potential in effecting a devastating combustion of fuel, further through the absorption by the mesh of heat generated by the flame thereby minimizing the heat available for fuel evaporation and finally through the mesh acting as a physical barrier to the promotion of the front of the flame, thereby averting increase of speed thereof and consequently of the build up of destructive pressures being generated through heat release of rapidly promoted self-sustained combustion of vapours or gases inevitably leading to catastrophic explosions. It is herein noted that the proposed expanded aluminium mesh rolls provide the abovementioned suppression of ignition and combustion of fuel whilst occupying a very small percentage of the order of less than 2% of the volume of the fuel tank.

It has however been found that the efficiency of the aforementioned product is dependent on the degree of filling of the tanks with the expanded aluminum mesh roll product and in many cases a sufficient degree of filling cannot be accomplished due to the configuration and sizing of the tank.

It is therefore the object of the present invention to disclose a device for the production of appropriately configured roll assemblies of expanded aluminium mesh adapted to efficiently fill fuel containers, wherein the device uses the cylindrically shaped rolls of expanded aluminium mesh provided by the machines disclosed in the aforementioned Greek patent certificates GR-1004528 and GR-1005763 to produce a variety of expanded aluminium mesh roll assemblies configured in a plurality of shapes and sizes, e.g. linearly, squarely, triangularly or elliptically configured mesh roll assemblies, so that a combination of such available expanded aluminium mesh roll assemblies of varying shapes and sizes may be employed to provide a maximally efficient filling of fuel tanks and subsequently increasing the efficiency thereof in the suppression of ignition and combustion of fuel contained therein.

An object of the invention is to provide a system for the production of selectively configured roll assemblies of expanded aluminium mesh adapted to efficiently fill fuel containers of all kinds used in the storage and transport of fuel, such system comprising in combination a first machine employed to produce rolls of expanded aluminum mesh having a standard relatively large diameter, a second unreeling-rereeling machine employed to be supplied with said first roll of expanded aluminum mesh and adapted to produce second rolls of selectively defined smaller diameters and a third machine employed to be supplied with said second rolls of selectively defined smaller diameters of expanded aluminum mesh and adapted to form selectively configured roll assemblies of expanded aluminium mesh, wherein an appropriate combination of said selectively configured roll assemblies of expanded aluminium mesh is employed for efficiently filling fuel containers of varying dimensions and configurations to provide suppression of ignition and combustion of the fuel contained therein.

An object of the invention also is the disclosure of a method of filling containers of varying sizes and configurations used in the storage and transport of fuel with an appropriate combination of the hereinabove mentioned selectively configured roll assemblies of expanded aluminium mesh so as to obtain maximal filling of the containers and thereby substantially increase the capacity of the product of the invention to provide suppression of ignition and combustion of fuel.

An object of the invention also is the disclosure of specific parameters of the configuration, composition and dimensions of the proposed expanded aluminum mesh product that would optimize its effectiveness for achieving the intended effect of efficiently suppressing ignition and combustion of the fuel content of containers, which have been appropriately filled with the hereinabove mentioned selectively configured roll assemblies of expanded aluminium mesh of the invention.

SUMMARY OF THE INVENTION

The invention discloses a device for the production of selectively configured roll assemblies of expanded aluminium mesh adapted to efficiently fill fuel containers, the device sequentially comprising a roll of expanded aluminium mesh being mounted at the inlet of the device and providing a mesh web flowing from the inlet to the outlet of the device, a mechanism adapted to provide tensioning of the mesh web, a mechanism adapted to provide a forward movement of the mesh web, a mechanism adapted to transversely cut a predetermined portion of the mesh web, a mechanism adapted to securely fold the edge of the transversely cut end of the mesh web to avert fraying and deterioration of the mesh, at least one arrangement of guiding rollers of the mesh web flowing from the inlet to the outlet of the device and a mechanism adapted to provide setting up a mesh roll assembly in varying configurations, such as linear, square, rectangular, triangular, elliptical, etc., wherein the mesh rolls used in setting up such a desirably configured assembly are selectively obtained from an unreeling-rereeling machine that produces mesh rolls of desired diameters, and wherein the mesh roll assembly is thereafter mounted onto a rotatable disc of this mechanism and is being wound with the mesh web flowing in the device of the invention to provide an end product of a variety of selectively configured roll assemblies of expanded aluminium mesh adapted to efficiently fill fuel containers, wherein the mesh roll assembly is being driven by the abovementioned mechanism adapted to provide a forward movement as soon as a predetermined portion is cut, whilst it is subsequently being driven through rotation of the abovementioned rotatable disc.

The invention further discloses a system for the production of the hereinabove mentioned selectively configured roll assemblies of expanded aluminium mesh adapted to efficiently fill fuel containers of all kinds used in the storage and transport of fuel, such system comprising in combination a first machine employed to produce rolls of expanded aluminum mesh having a standard relatively large diameter, a second unreeling-rereeling machine employed to be supplied with this first roll of expanded aluminum mesh and adapted to produce second rolls of selectively defined smaller diameters and a third machine employed to be supplied with the abovementioned second rolls of selectively defined smaller diameters of expanded aluminum mesh and adapted to form the selectively configured roll assemblies of expanded aluminium mesh, wherein an appropriate combination of said selectively configured roll assemblies of expanded aluminium mesh is employed for efficiently filling fuel containers of varying dimensions and configurations to provide suppression of ignition and combustion of the fuel contained therein.

The invention also discloses detailed structural parameters of the expanded aluminium mesh product that is formed by laterally stretching an aluminium sheet having a plurality of slits cut therein, the slits being oriented parallel to the longitudinal axis of the aluminium sheet and illustratively having a hexagonal configuration

DETAILED DESCRIPTION OF PREFERRED EMBODIMENTS

According to at least one exemplary embodiment, the present invention is related to appropriately forming previously manufactured rolls of expanded metallic mesh that comprises a plurality of equally sized apertures along the longitudinal axis of the foil, e.g. aluminium foil, wherein the expanded metallic mesh is being configured in an appropriate variety of shapes that can be used in appropriate combinations for attaining nearly thorough filling of fuel tanks and provide averting of ignition and combustion of the fuel content thereof that might occur due to exposure of the fuel tanks to varying risks, such as crashes, fire, terrorist activity, erroneous maintenance or human error. The herein proposed expanded metallic mesh occupies a minimal percentage of less than 2% of the net volume of the tank despite of the fact that it is being arranged to cover a maximal percentage exceeding 90% of the space within a tank containing fuel.

FIGS. 1*a*-1*d* illustratively depict an expanded metallic mesh 100 adapted to provide suppression of combustion and evaporation of combustible substances contained in a tank that is appropriately filled with the expanded metallic mesh 100. The expanded metallic mesh 100 may be manufactured by the mesh production apparatus described in Greek Patent Certificate 1004528, the entire contents of which are incorporated by reference herein. The expanded metallic mesh 100 may be formed by laterally stretching a sheet of metal foil with slits cut therein, the slits having been previously cut parallel to the longitudinal axis of the sheet of the metal foil.

Figure 1A:
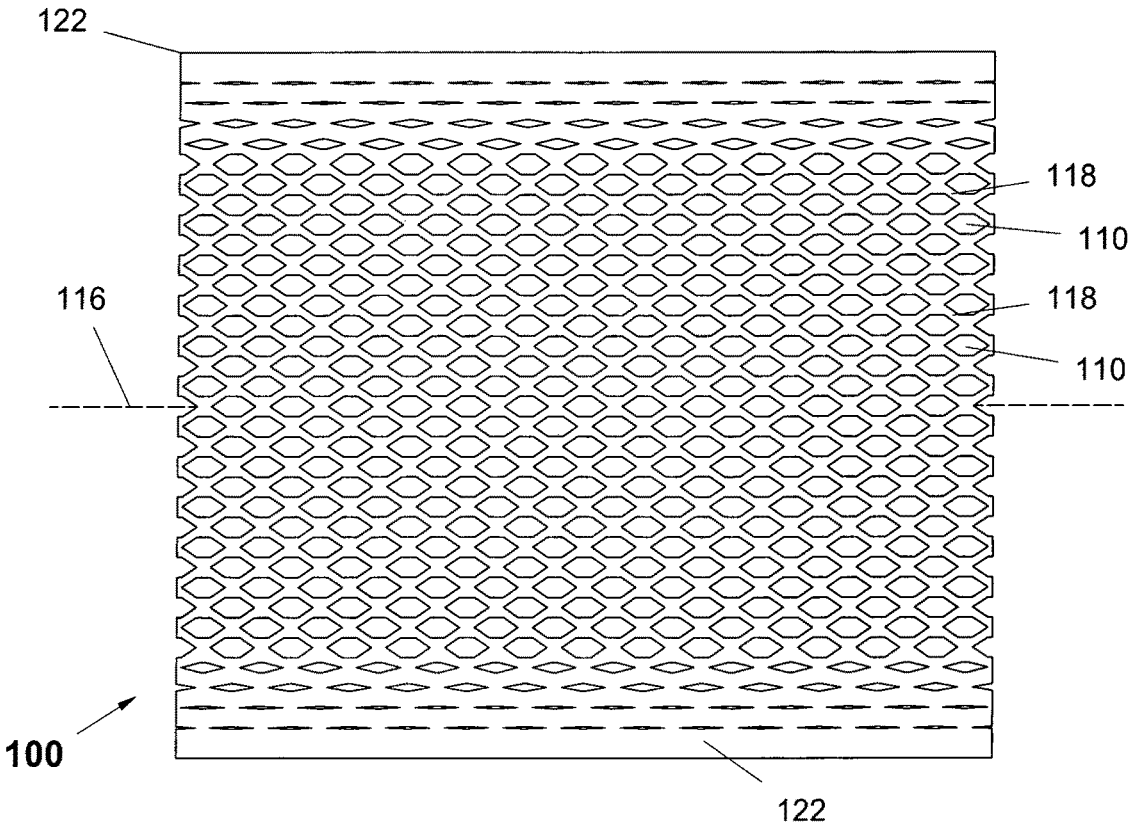
FIG. 1*a* shows a planar view of a portion of the expanded aluminium mesh sheet product of an embodiment of the invention.
Figure 1B:
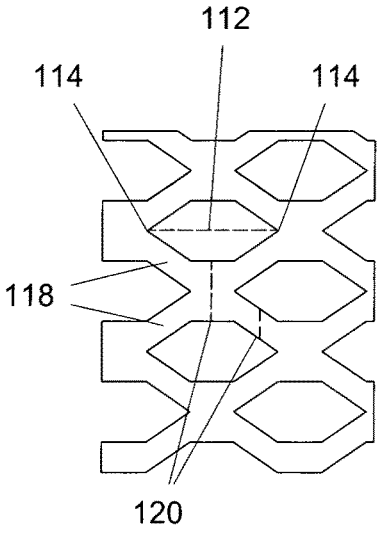
FIG. 1*b* shows a detail of the expanded aluminium mesh sheet of FIG. 1*a*.
Figure 1C:
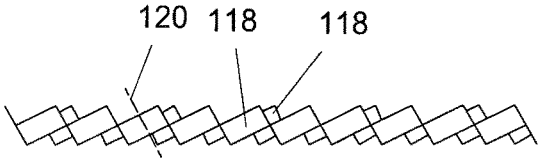
FIG. 1*c* shows a cross-sectional view along a transverse axis of a portion of the expanded aluminium mesh sheet of FIG. 1*a*.
Figure 1D:
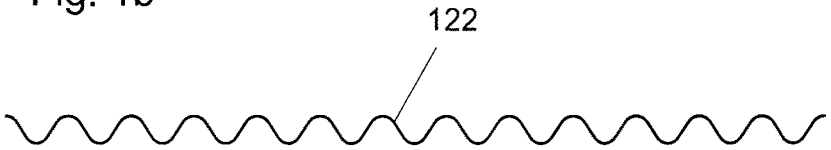
FIG. 1*d* is a view of a longitudinal edge of the expanded aluminium mesh sheet of FIG. 1*a*.

The metallic sheet used for the production of the expanded metallic mesh 100 preferably is an aluminium alloy. The composition of this aluminium alloy may comprise up to 0.25% Si, up to 0.40% Fe, up to 0.10% Cu, up to 0.10% Mn, between 2.20% and 2.40% Mg up to 0.15% Cr, up to 0.10% Zn, and Al remainder. Moreover, in some embodiments, the alloy may additionally contain up to 0.15% of other metals, if desired, with each of these metals being used in a percentage lower than 0.005% in the alloy composition. As a consequence of the lateral stretching of the sheet of aluminium alloy foil, the expanded metallic mesh 100 shown in FIG. 1*a* is formed with a plurality of substantially hexagonally shaped apertures 110. In some exemplary embodiments, the spacing between the slits may be approximately 2 mm to approximately 3 mm in the longitudinal direction, and approximately 1.0 mm to 1.5 mm in the transverse direction. Consequently, as shown in FIG. 1*b*, the apertures 110 may be oriented such that the axis 112 between a pair of opposite vertices 114 of each aperture 110 is disposed parallel to the longitudinal axis 116 of the mesh 100. Apertures 110 may be bounded by continuous metal strips 118, all strips 118 having substantially the same widths with respect to each other. In some exemplary embodiments, the widths of the strips 118 may be approximately 1.0 mm to 1.5 mm. The transverse axes 120 of strips 118 may be oriented obliquely to the plane of mesh 100, so as to present a substantially stepped configuration, as shown in FIG. 1*c*. Mesh 100 may have any desired length or width, which may depend on the desired application of mesh 100, for example the volume, shape, and configuration of the container in which rolls of mesh 100 may be disposed. In some embodiments, the sheet of metal foil from which mesh 100 is formed may have a width between approximately 75 mm and approximately 125 mm, with the sheet then being stretched to a desired width. Furthermore, the sheet of metal foil may have a thickness of approximately 70 pm, as thinner sheets may be unstable, while thicker sheets may be stiffer, have greater weight, and occupy a greater volume without increasing the efficacy of the mesh. In some exemplary embodiments, the longitudinal edges 122 of expanded metal mesh 100 may be crimped so as to reduce the likelihood of fraying of mesh 100 at the longitudinal edges 122, thereby preventing the detachment of mesh particles from mesh 100. Edges 122 may further be crimped so as to present an undulating profile, as shown in FIG. 1*d*. Crimping of edges 122 may be accomplished during the manufacturing process of mesh 100, or may be accomplished post-manufacture.

As shown in FIG. 17, the present invention relates to an integrated system for the production and appropriate forming of the expanded aluminium rolls adapted to fill containers of combustible substances. A first machine 102 as described in Greek Patent Certificate 0.1004528 is employed to produce an expanded aluminum mesh adapted to fill fuel tanks and provide suppression of ignition and combustion of the fuel contained therein. A second unreeling-rereeling machine 104 as described in Greek Patent Certificate 1005763 is employed to produce rolls of specific diameters. Eventually, a third machine 106 being disclosed in the present invention is employed to form roll assemblies in appropriate configurations for filling containers of combustible substances in the potentially maximal extent so as to provide a maximally efficient performance of the expanded aluminium mesh 100.

As described in Greek Patent Certificate 1004528, a desired quantity of the expanded metal mesh 100 produced by the aforementioned first machine 102 may be wound into a first mesh roll 102*a*. In some exemplary embodiments, the first mesh roll may have a diameter of, for example, greater than 60 cm. The first mesh roll 102*a* can then be utilized with an exemplary embodiment of the second aforementioned unreeling-rereeling machine 104, which can generate at least one second mesh roll 104*a* from the first mesh roll 102*a*. The diameter of the second mesh roll 104*a* is less than the diameter of the first mesh roll 102*a* and can be adjusted as desired depending on the size and configuration of the particular container in which rolls 104*a* may be disposed. Second mesh rolls 104*a* are further thereafter being used in the third aforementioned machine 106 to be described hereinafter, which performs appropriate forming of roll assemblies 17 for efficiently filling fuel containers of various dimensions and configurations.

Figure 2:
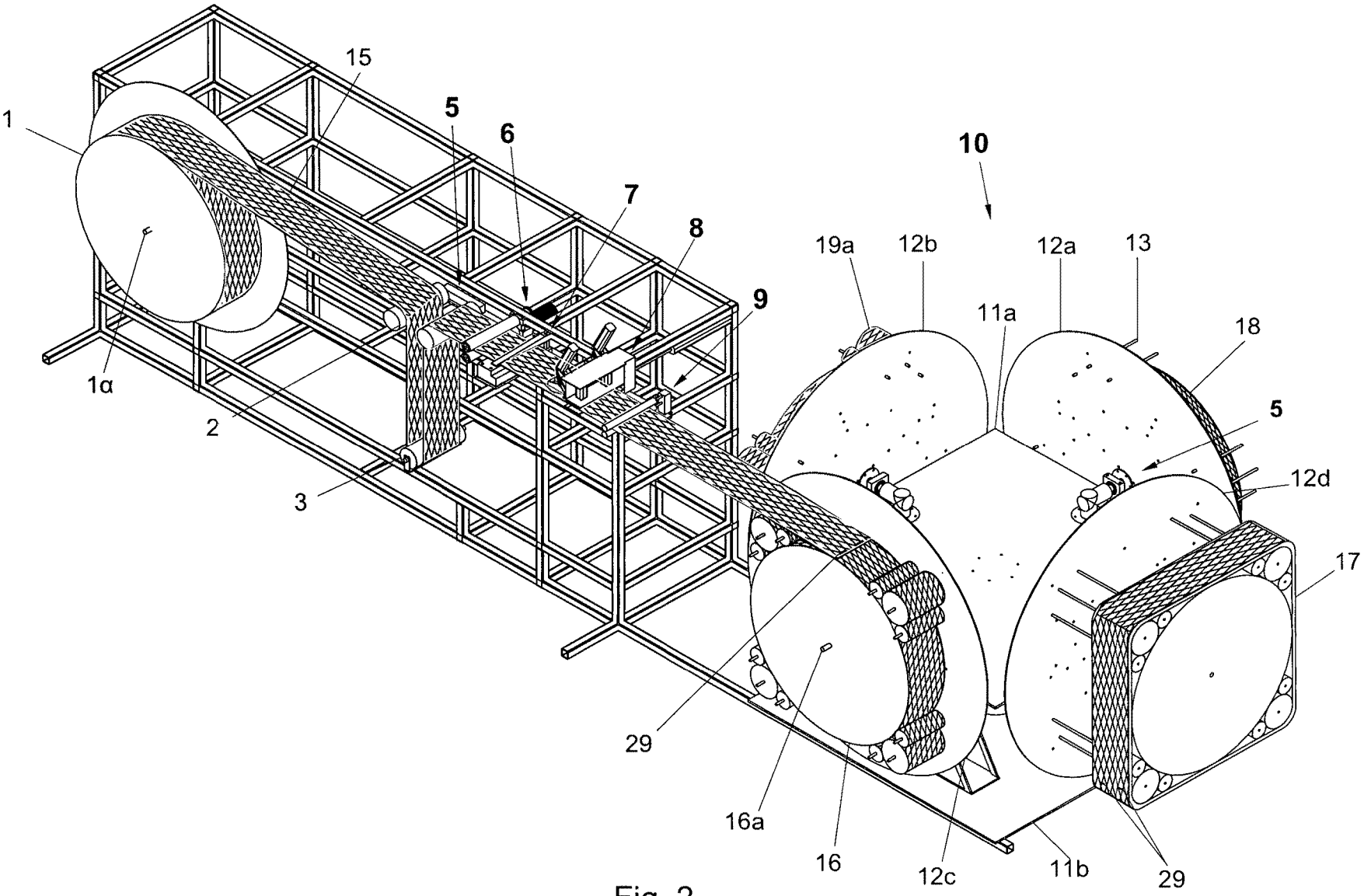
FIG. 2 shows a perspective view of a preferred embodiment of the device of the invention adapted to form appropriately configured roll assemblies of the expanded aluminium mesh.

As shown in FIG. 2 the device adapted to perform forming of roll assemblies of varying configurations of the expanded aluminium mesh 100 comprises a metal frame onto which are being mounted the mechanisms adapted to provide functioning of the device.

Figure 2A:
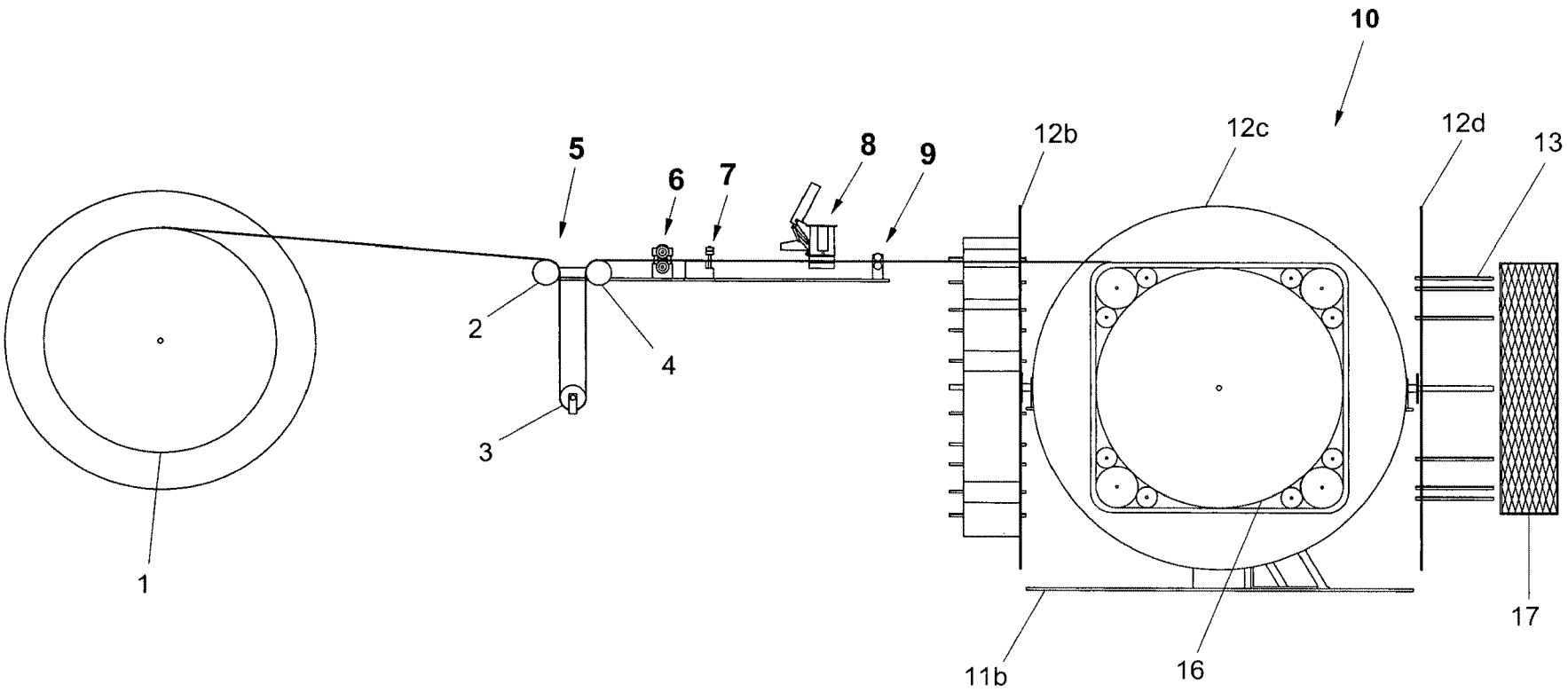
FIG. 2*a* shows a frontal view of the device of FIG. 2.

Specifically, a roll 1 of the previously produced expanded aluminium mesh is obtained from the output of either the aforementioned unreeling-rereeling machine 104 and is positioned onto a shaft 1*a* at the inlet of the device 106 of the present invention and a continuous expanded aluminium mesh web 15 is arranged to flow from the roll 1 at the inlet to the output of the device wherein, as illustratively shown in FIG. 2 and in FIG. 2*a*, the expanded aluminium mesh web 15 is adapted to be wound around a square-shaped roll assembly 16.

A mechanism 5 adapted to provide tensioning of mesh web 15, a mechanism 6 adapted to provide a forward movement of mesh web 15, a mechanism 7 adapted to transversely cut mesh web 15, a mechanism 8 adapted to securely fold the edge of the cut end of mesh web 15, at least one arrangement of guiding rollers 9 and a mechanism 10 adapted to provide setting a desirably configured mesh roll assembly and winding mesh web 15 around this mesh roll assembly to provide an end product are sequentially mounted between the inlet and outlet of the device of the invention.

Figure 3:
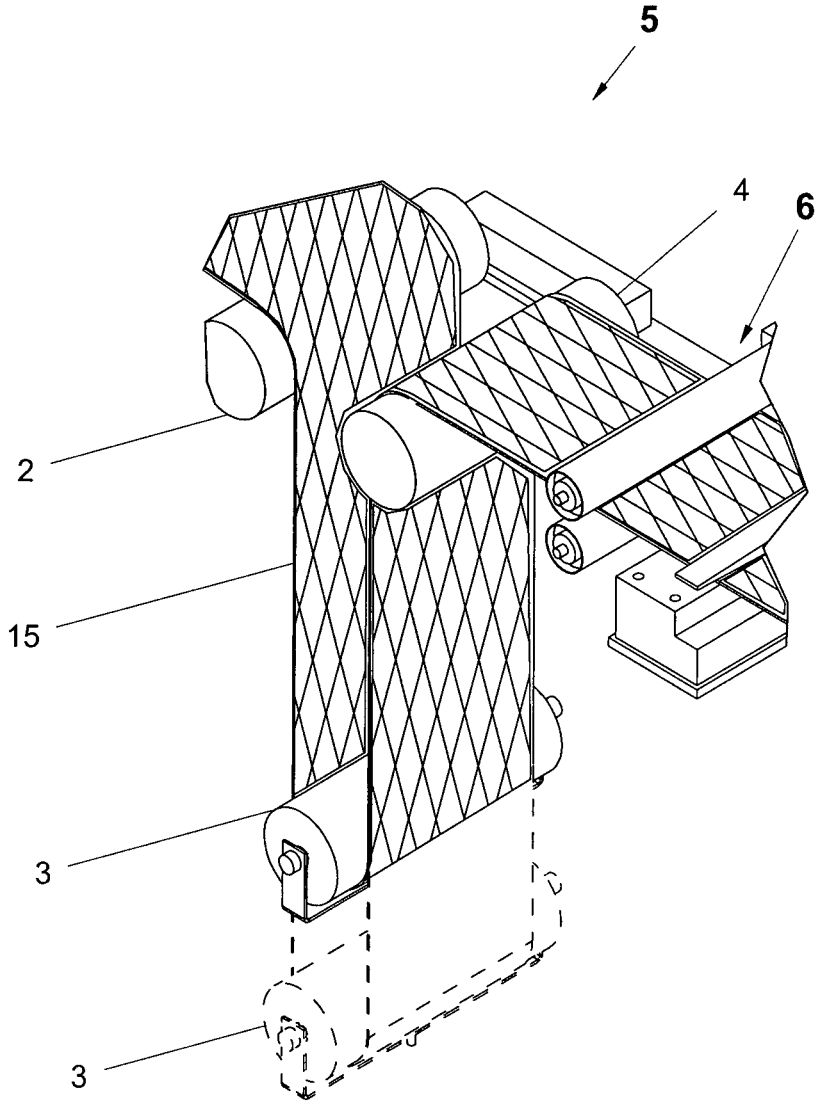
FIG. 3 shows a detail view of the mechanism adapted to provide tensioning of the expanded aluminium mesh web being driven from the inlet to the outlet of the device of FIG. 2 to produce a desirably configured mesh roll assembly from the initially cylindrical mesh roll.
Figure 4:
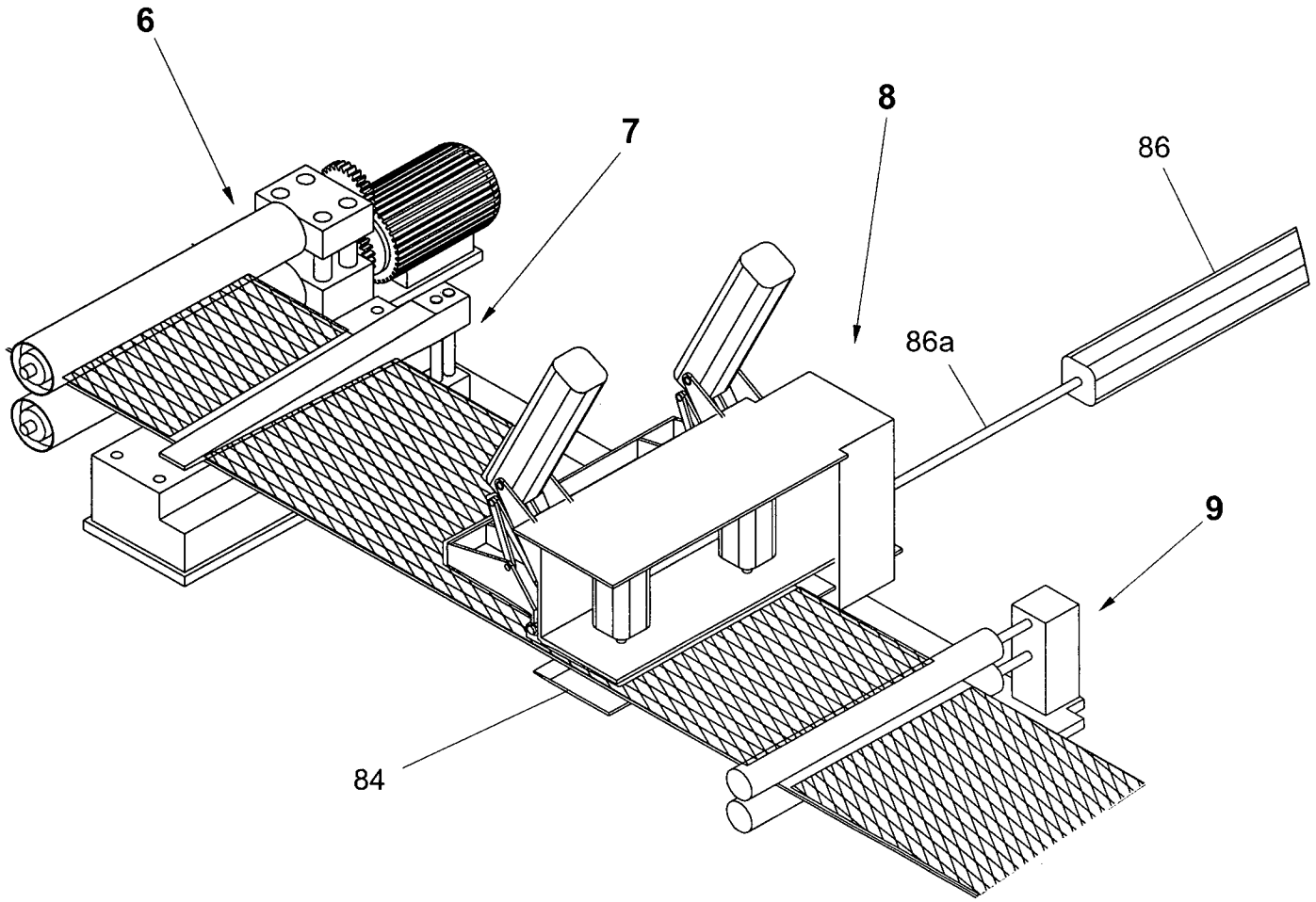
FIG. 4 shows a detail view of the device of FIG. 2 downstream of the tensioning mechanism of FIG. 3, comprising a mechanism adapted to provide a forward movement of the expanded aluminium mesh web, a mechanism adapted to transversely cut the mesh web following completion of the winding thereof around the desirably configured mesh roll assembly at the outlet of the device of FIG. 2, and a mechanism adapted to provide folding of the cut edge of the mesh web.

As shown in the detailed view of FIG. 3 of the mechanism 5 adapted to provide tensioning of web 15 of the expanded aluminium mesh and ensure a predetermined tension thereof, this mechanism comprises a pair of rollers 2 and 4, which are spaced apart at a distance that corresponds to the diameter of a tensioning roller 3 that is mounted within a socket being formed by the web 15 being sunk downwardly in between the aforementioned rollers 2 and 4. As web 15 flows from the inlet to the outlet of the device, the tensioning roller 3 is adapted to slide vertically within the abovementioned socket thereby downwardly pulling the flowing web 15 to ensure a steady predetermined tension thereof.

Figure 5A:
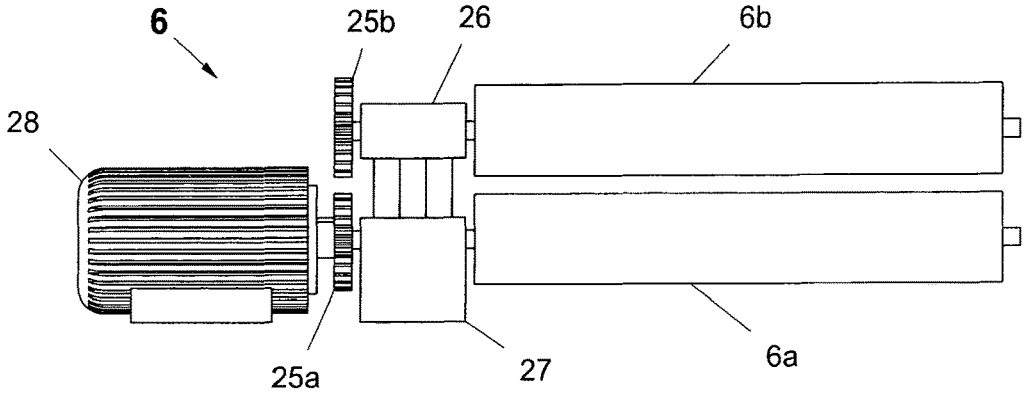
FIGS. 5*a* and 5*b* show a cross-sectional view of the mechanism adapted to provide a forward movement of the expanded aluminium mesh web that is shown in FIG. 5 in an idle condition and in an active condition of performing the forward movement of the mesh web respectively.
Figure 5B:
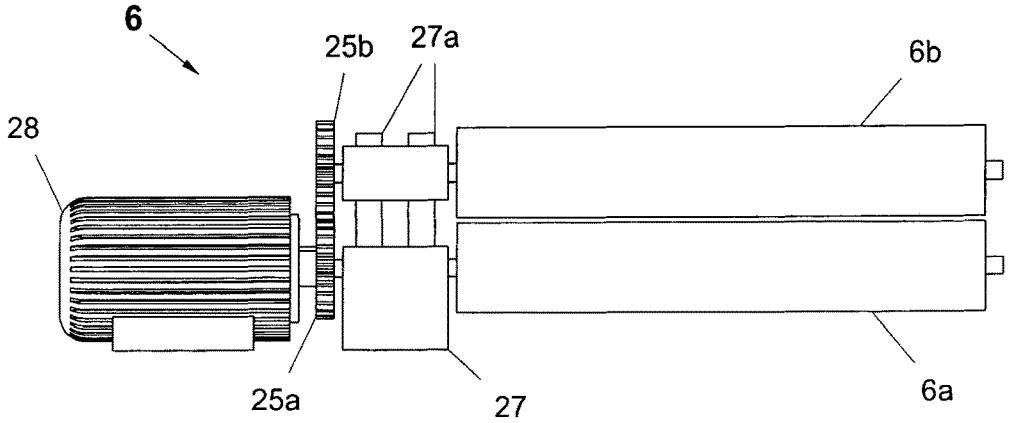
Figure 5:
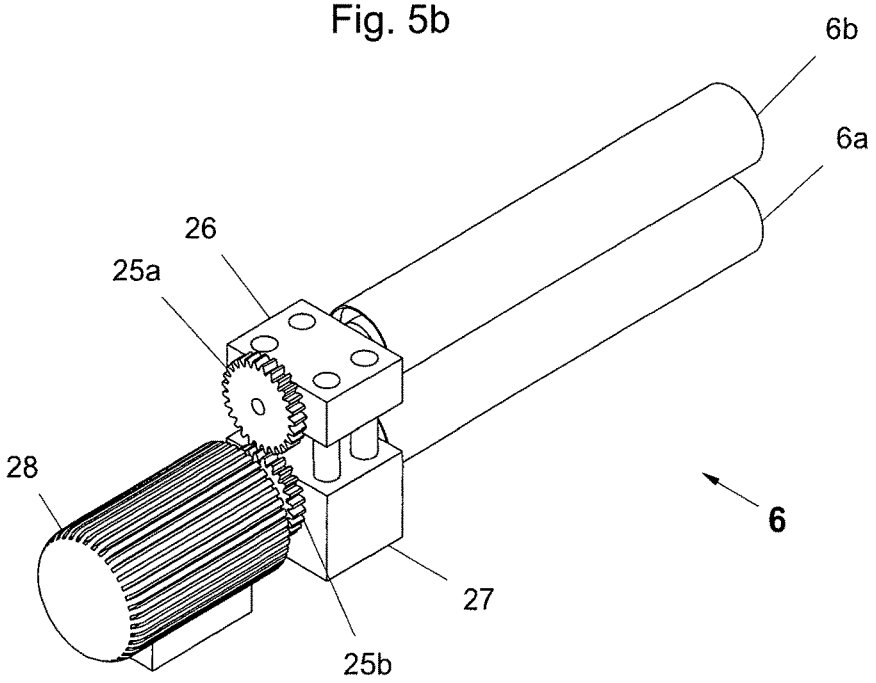
FIG. 5 shows a detailed perspective view of the mechanism adapted to provide a forward movement of the expanded aluminium mesh web.
Figure 6A:
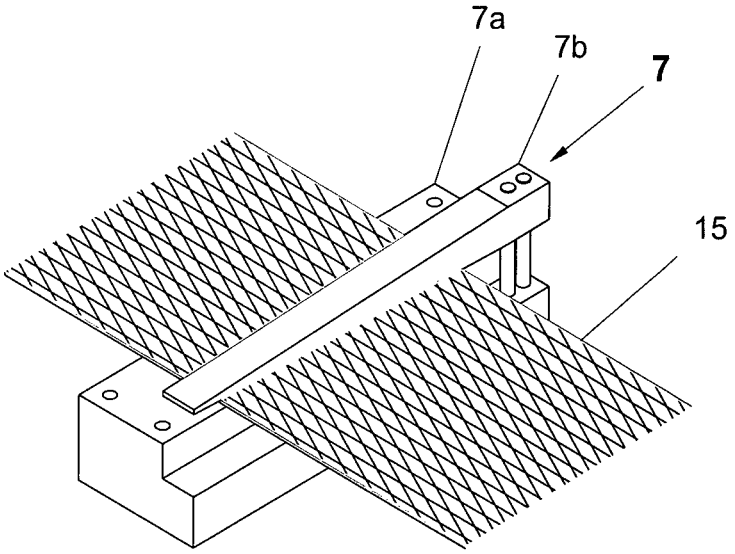
FIGS. 6*a* and 6*b* show a detailed perspective view of the mesh web cutting mechanism in an idle condition and in an active condition of cutting the mesh web respectively.
Figure 6B:
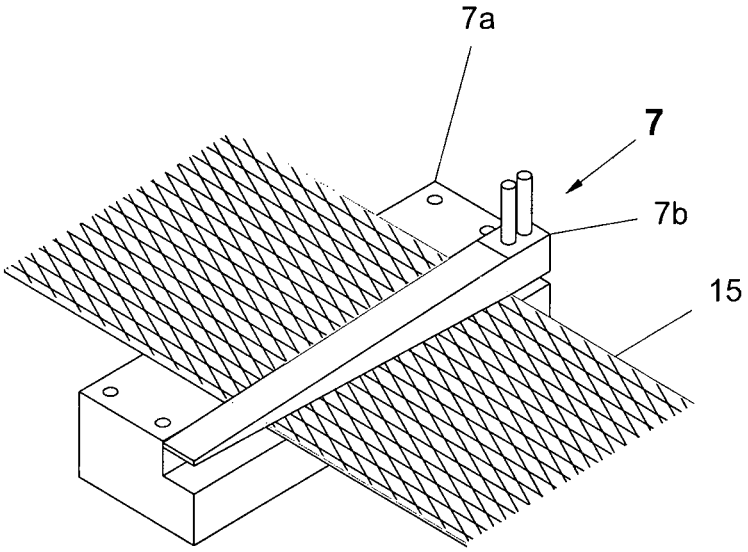

The mechanism 6 illustrated in FIGS. 5, 5*a* and 6*b* is adapted to provide a forward movement of web 15 being derived from the roll 1 of the previously produced expanded aluminium mesh at the inlet of the device, such forward movement being initiated immediately after completion of an operational cycle with a web portion having been transversely cut and being led at the mechanism 10 arranged to produce the desirably configured mesh roll assembly that is the end product deliverable at the outlet of the device of the invention. The forward movement of web 15 powered by the mechanism 6 is terminated as soon as web 15 abuts and is appropriately stapled along a transverse line of stapling 29 shown in FIG. 2 onto the mesh roll assembly 16 provided onto a rotatable disc 12*c* of mechanism 10 since thereafter further movement of web 15 is powered by the rotatable disc 12*c*.

As shown in FIG. 5, the mechanism 6 adapted to provide a forward movement of web 15 comprises a pair of equally sized rollers 6*a*, 6*b* oriented in parallel, below and above the flowing web 15 respectively. A fixedly mounted base 27 is provided at one side of roller 6*a* underlying web 15 and a rotatable centrally oriented longitudinal shaft of roller 6*a* passes through this base 27 and is connected to a drive gear 25*a*. Accordingly, a gear 25*b* is connected at the end of a centrally oriented longitudinal shaft of roller 6*b* overlying web 15, wherein this shaft of roller 6*b* passes through a base 26 that is supported by an array of pillars 27*a* that protrude perpendicularly upwardly from the abovementioned fixedly mounted base 27, wherein pillars 27*a* and henceforth base 26 are adapted to move reciprocatingly by means of a pneumatic drive that is not depicted in the drawings, such reciprocating movement of base 26 alternatively providing engagement of gear 25*b* with drive gear 25*a* (FIG. 5*b*) or disengagement of the same (FIG. 5*a*). Drive gear 25*a* is being driven by motor 28 illustrated at the side thereof. The reciprocating base 26 is adapted to alternatively provide engagement of gear 25*b* with drive gear 25*a* thereby initiating, through activation of motor 28 a forward stroke of mesh web 15 flowing in between rollers 6*a*, 6*b* or disengagement of gear 25*b* from drive gear 25*a* thereby allowing free passage of mesh web 15 flowing in between rollers 6*a*, 6*b*.

The mechanism 7 adapted to transversely cut mesh web 15 is shown in an idle condition in FIG. 6*a* and in an active condition in FIG. 6*b*. Mechanism 7 comprises a fixedly mounted base member 7*a* that is mounted underneath the flowing mesh web 15 and a cutting blade 7*b* that is arranged above base member 7*a* overlying the mesh web 15 and moving downwardly during a cutting operation to be brought in abutment with base 7*a* and perform transverse cutting of the mesh web 15 contained therebetween.

Figure 7A:
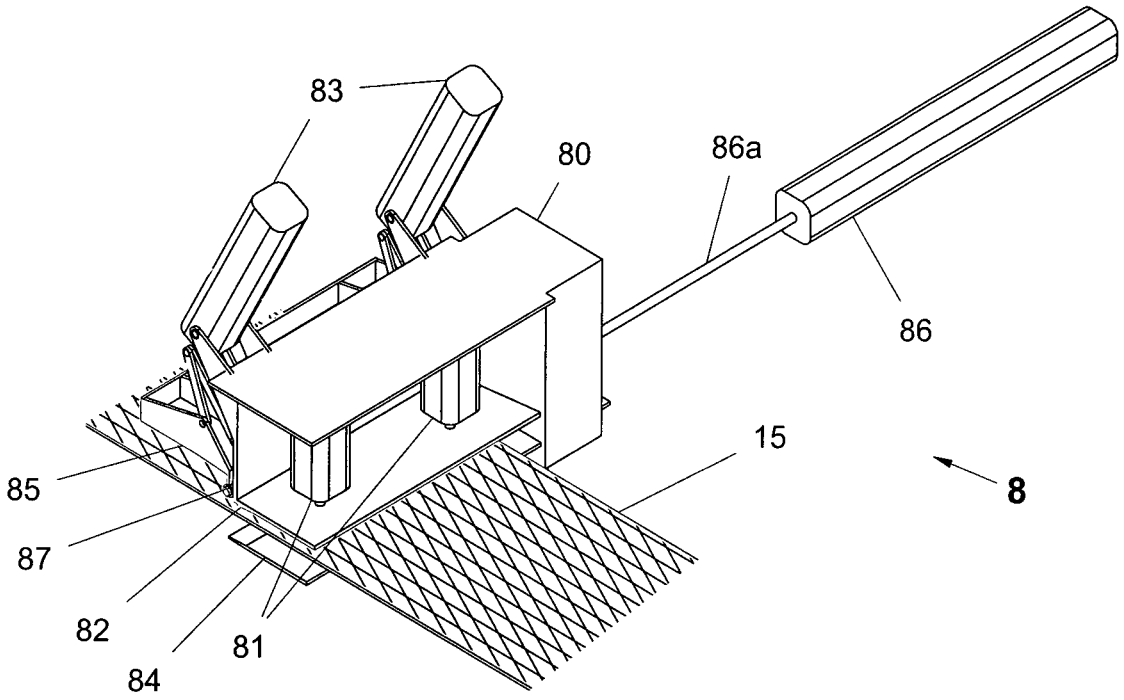
FIGS. 7*a* and 7*b* illustrate a detailed perspective view of two discrete phases of operation of the mechanism adapted to provide folding of the cut edge of the mesh web.
Figure 7B:
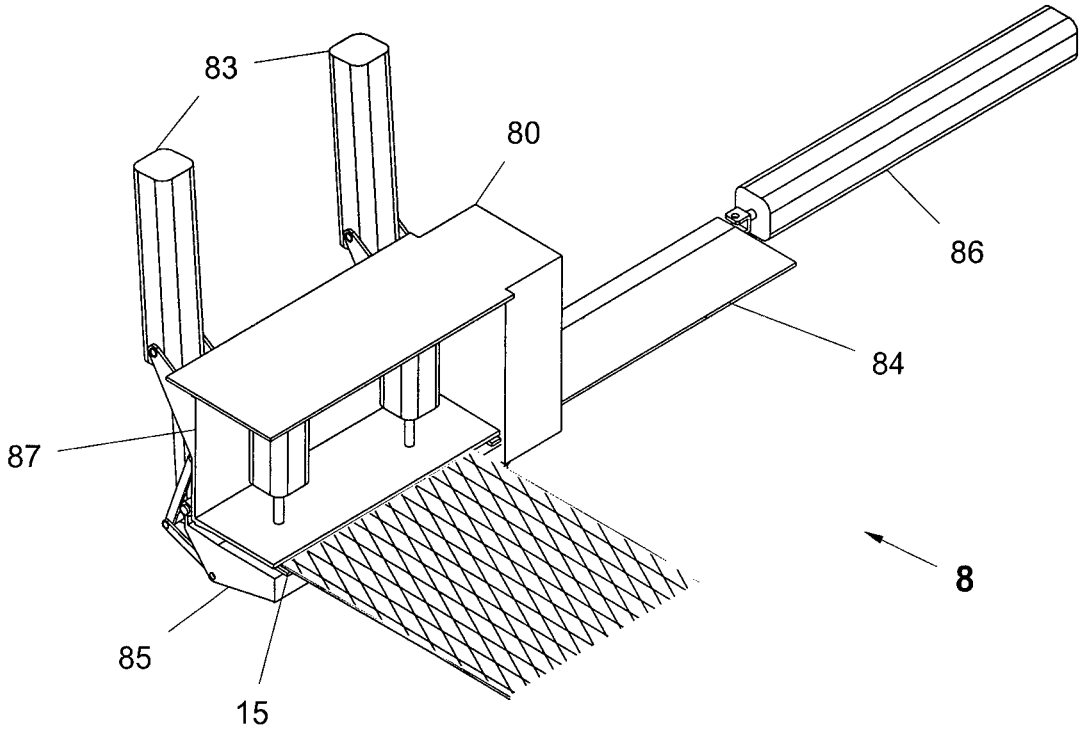
Figure 8A:
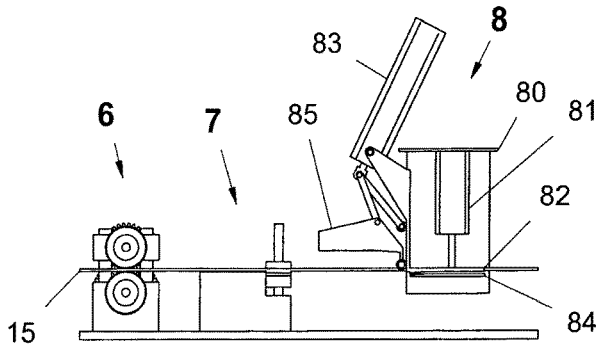
FIGS. 8*a*-8*d* sequentially show the operations of mesh web cutting by the mesh web cutting mechanism, of folding of the cut edge of the mesh web by the mechanism adapted to provide folding of the cut edge of the mesh web and of forwardly moving of a new mesh web portion after completion of the previous operational cycle with the removal of the cut mesh web portion and folding of the cut edge thereof.
Figure 8B:
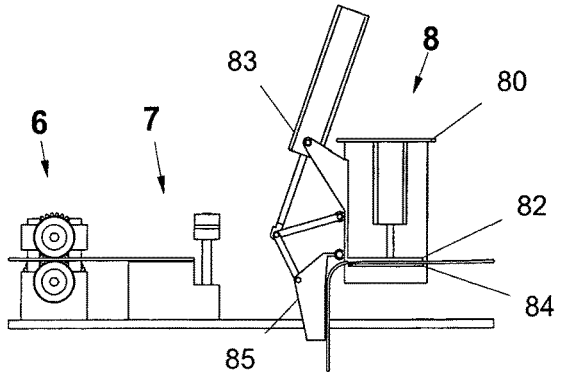
Figure 8C:
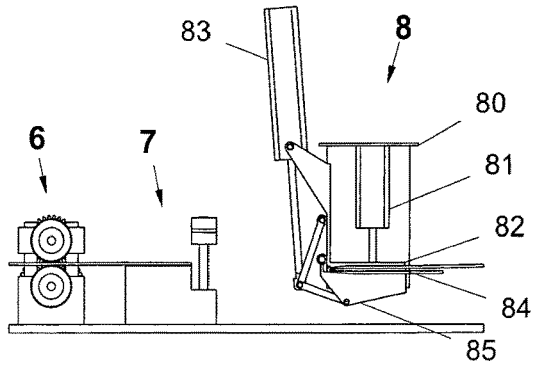
Figure 8D:
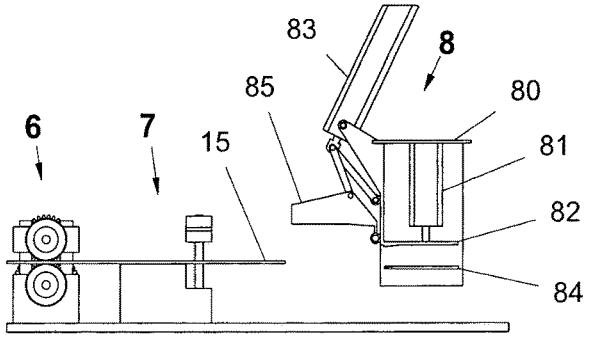

FIGS. 7*a* and 7*b* show an illustrative embodiment of mechanism 8 that is adapted to securely fold the edge of the cut end of mesh web 15 and is located downstream of cutting mechanism 7 described hereinabove. Mechanism 8 comprises a parallelepipedal block member with an upper base 80, a lower base 82 and a lateral base 87 interconnecting upper base 80 and lower base 82, wherein upper base 80, lower base 82 and lateral base 87 extend along the transverse direction of mesh web 15. A pair of vertically oriented pneumatic cylinders 81 is disposed in between upper base 80 and lower base 82 and is adapted to provide reciprocating movement of the lower base 82. A plate 85 having dimensions equivalent to those of the lower base 82 is pivotally mounted onto the lateral base 87 exteriorly of the parallelepipedal block member and overlying the flowing mesh web 15 whilst mechanism 8 is found in idle condition as illustrated in FIG. 8*a*. A pair of pneumatic cylinders 83 is adapted to perform a rotational stroke of plate 85 and bring the latter in a position underlying lower base 82 as illustrated in FIGS. 8*b*, 8*c*, such rotational stroke being initiated immediately after the performance of a cutting operation of mesh web 15. Furthermore, a pneumatic cylinder 86 and piston 86*a* arrangement is provided at one of the narrow sides of the parallelepipedal block, such cylinder 86 and piston 86*a* arrangement being adapted to provide a reciprocating movement of a plate 84 that has dimensions equivalent to those of the lower base 82 and of the plate 85 that is rotated to be brought underneath the lower base 82 after the performance of a cutting operation of mesh web 15. Prior to that rotational stroke of plate 85, the aforementioned cylinder and piston arrangement 86-86*a* initiates a linear movement of plate 84 that results in plate 84 being brought underneath lower base 82 and underneath mesh web 15 that abuts the upper surface thereof as shown in FIG. 7*a* and in FIG. 8*a*. It is then that the rotational stroke of plate 85 is initiated (FIG. 8*b*) and, when this rotational stroke is terminated, plate 84 lies in between the lower base 82 and plate 85 with the mainstream mesh web 15 lying above it and the end portion thereof with the transversely cut edge lying underneath it as shown in FIG. 8*c*. In this position a folded edge of the cut web portion is obtained through operation of the pneumatic cylinders 81 that provide a downward movement of base 82 and exertion of a slight pressure onto the underlying plate 84 and accordingly onto the mesh web 15. Following completion of an operational cycle as described hereinabove, a rearward linear movement of plate 84 is performed as shown in FIG. 7*b* and a return rotational stroke of plate 85 is also initiated by the pneumatic cylinders 83 so as to bring mechanism 8 at an idle condition, ready to accept a new mesh web portion 15 being promoted by an operational cycle of mechanism 6 described hereinabove.

Mechanism 10 is provided at the outlet of the device of the invention and is adapted to provide setting up a desirably configured mesh roll assembly 16 and thereafter to provide winding mesh web 15 around this desirably configured mesh roll assembly 16 that is mounted onto shaft 16*a* to provide an end product 17 composed of the combination of mesh rolls of the expanded aluminum mesh contained in the aforementioned roll assembly 16 including a predetermined number of turns thereupon of the mesh web 15 derived from roll 1 at the inlet of the device.

Figure 9:
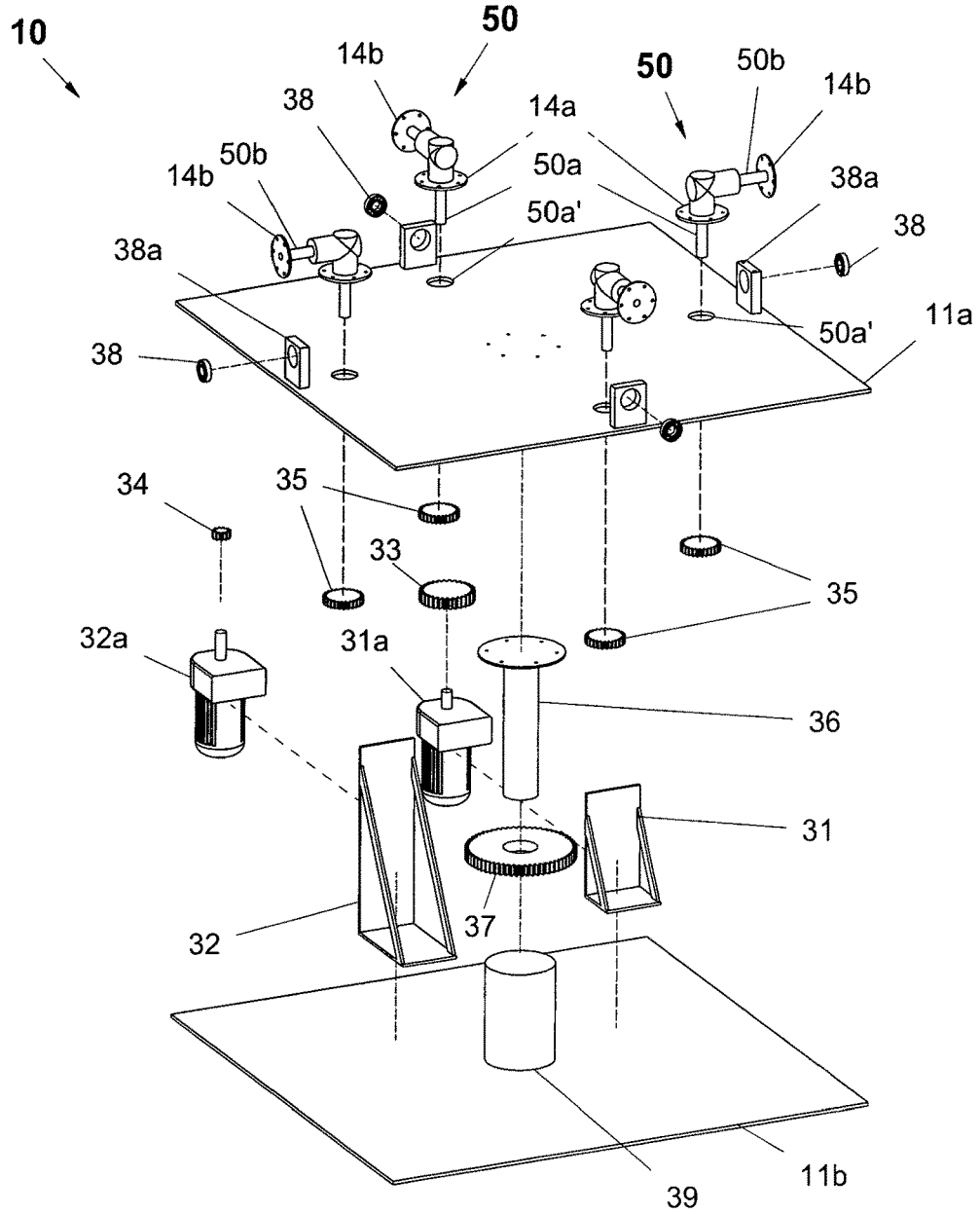
FIG. 9 shows an exploded perspective view of the components and parts making up the mechanism adapted to provide setting a desirably configured mesh roll assembly and of winding the mesh web around this mesh roll assembly to provide an end product of the device of the invention.

As illustrated in FIG. 9, the aforementioned mechanism 10 that provides the desirably configured end product 17 composed of the combination of mesh rolls of the expanded aluminium mesh comprises a fixed lower table 11*b* and an upper rotatable table 11*a*. A tubular shaft 39 extends vertically upwardly from the center of the upper surface of the fixed abovementioned lower table 11*b* and a shaft 36 with a gear 37 at the free end thereof extends vertically downwardly from the center of the bottom surface of the upper rotatable table 11*a*, wherein shaft 36 is inserted within the tubular shaft 39 and is adapted to rotate therein. Motors 31*a* and 32*a* with drive gears 33, 34 respectively at the shafts thereof are provided within supporting structures 31 and 32 respectively provided onto the upper surface of the fixed abovementioned lower table 11*b*.

Figure 9D:
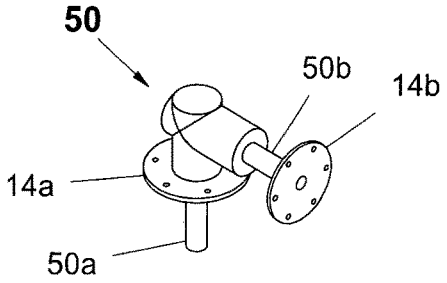
FIG. 9*d* shows a detail view of an angularly configured motion transmission mechanism that is mounted proximally to each one of the four sides of a rotatable upper table of the mechanism depicted in FIG. 9.
Figure 9A:
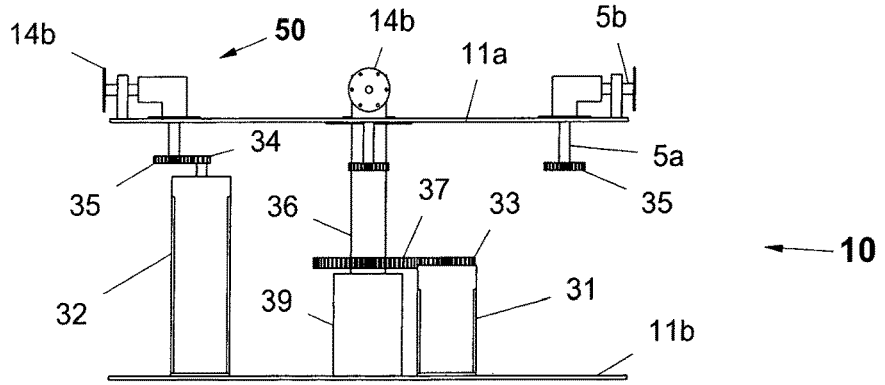
FIG. 9*a* shows a side view of the assembled mechanism of FIG. 9.
Figure 9B:
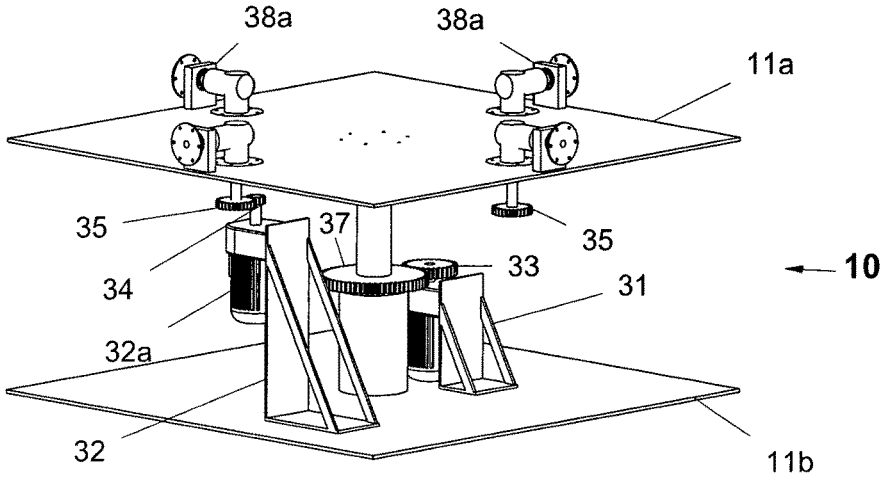
FIG. 9*b* shows a perspective view of the assembled mechanism of FIG. 9.
Figure 9C:
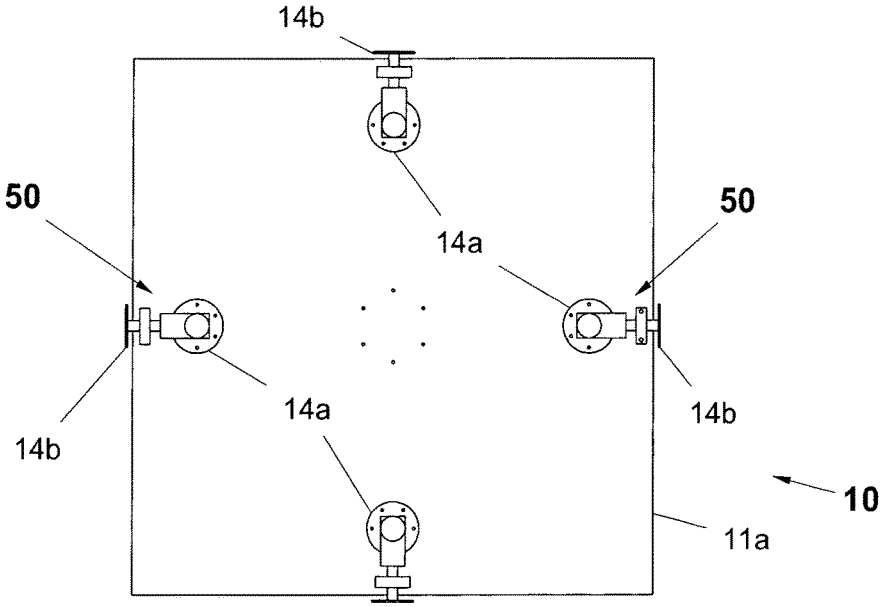
FIG. 9*c* shows a top planar view of the assembled mechanism of FIG. 9.

Bearings 38 are mounted onto upwardly oriented support structures 38*a* provided onto the upper surface centrally at the edge of each of the four sides of the rotatable upper table 11*a*. An angularly configured motion transmission mechanism 50 is mounted proximally to each one of the abovementioned bearings 38. As illustratively shown in FIG. 9*d*, each angularly configured motion transmission mechanism 50 comprises a vertically extending shaft 50*a* that passes through a hole 50*a*' of upper table 11*a* and a horizontally extending shaft 50*b* that passes through the respective bearing 38. Flanges 14*a*, 14*b* are provided in shafts 50*a* and 50*b* respectively, wherein flange 14*a* is adapted to fixedly mount the angularly configured motion transmission mechanism 50 onto the upper table 11*a*, whilst flange 14*b* is adapted to mount mechanism 50 centrally onto each one of four vertically oriented discs 12*a*, 12*b*, 12*c*, 12*d* correspondingly provided in each of the four sides of the rotatable table 11*a*. A gear 35 is mounted at the end of shaft 50*a* of each one of the mechanisms 50 that protrudes from the bottom of table 11*a*, such gear 35 being adapted to engage drive gear 34 of motor 32*a*, whereby as the rotatable table 11*a* performs a 90° rotational stroke at each time, one of the four vertically oriented discs 12*a*, 12*b*, 12*c*, 12*d* is alternatively brought in a condition wherein the gear 35 of the mechanism 50 thereof is engaged with the drive gear 34 of motor 32*a* and therefore this disc is rotated to implement winding of mesh web 15 around the desirably configured mesh roll assembly 16 that has been mounted onto a shaft 16*a* thereof. A predetermined number of turns of the rotatable disc to produce an appropriate end product is normally of the order of 5-10 turns.

Figure 11A:
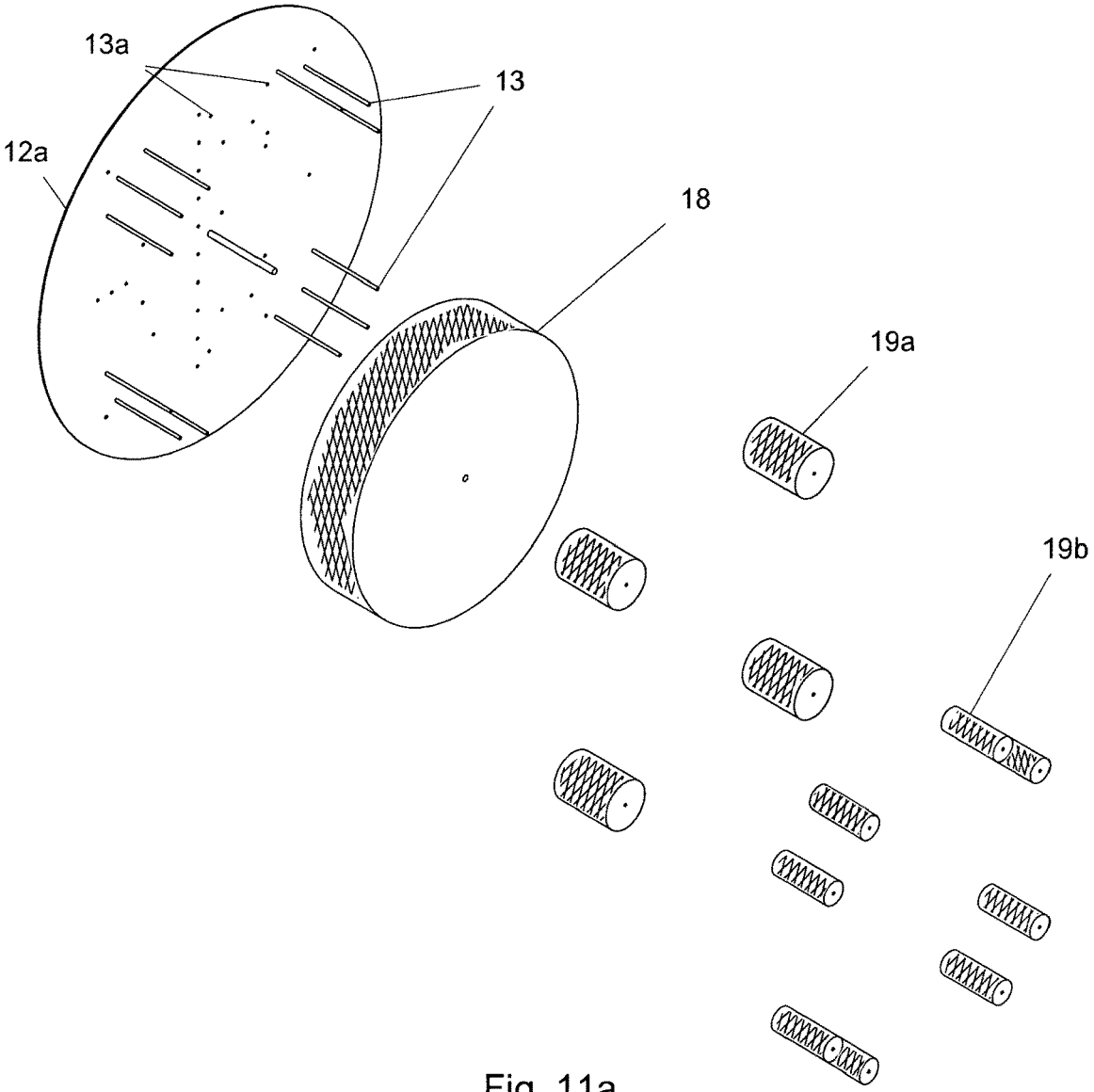
FIG. 11*a* shows an exploded perspective view of a disc of the mechanism of FIGS. 10*a*, 10*b*, of the pins selectively mounted onto the disc and of the mesh rolls being mounted onto these pins in order to produce an eventual end product of the invention being configured in a square shape.
Figure 11B:
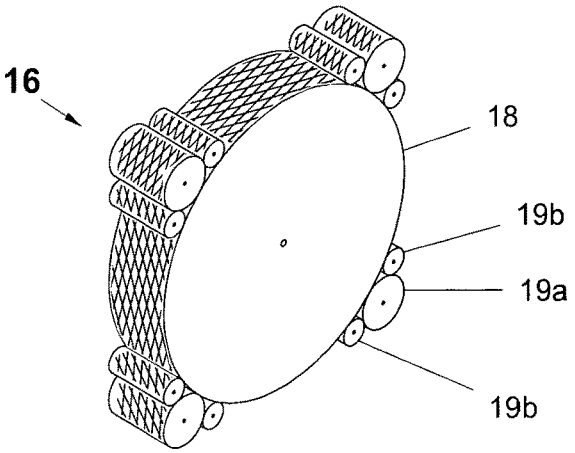
FIG. 11*b* shows a perspective view of a squarely shaped end product of the invention prior to winding around it the mesh web being provided in the device of the invention.
Figure 12A:
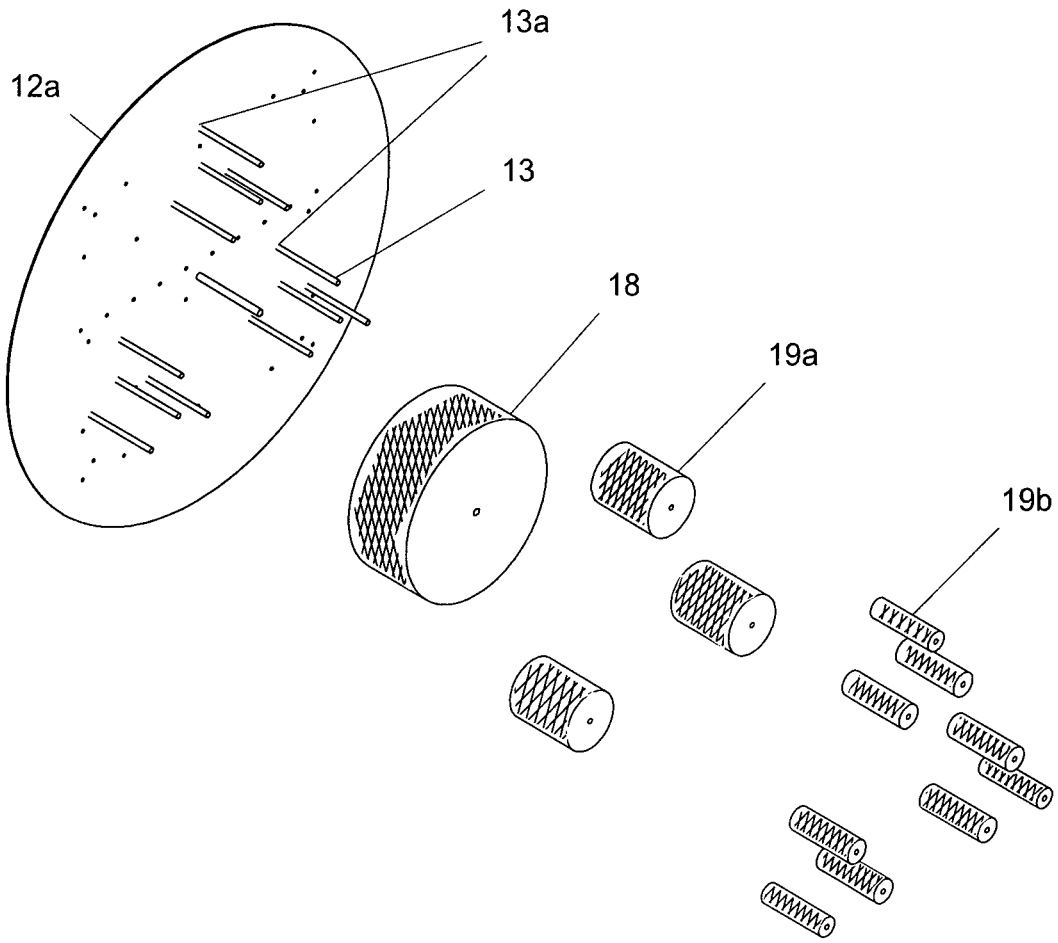
FIG. 12*a* shows an exploded perspective view of a disc of the mechanism of FIGS. 10*a*, 10*b*, of the pins selectively mounted onto the disc and of the mesh rolls being mounted onto these pins in order to produce an eventual end product of the invention being configured in a triangular shape.
Figure 12B:
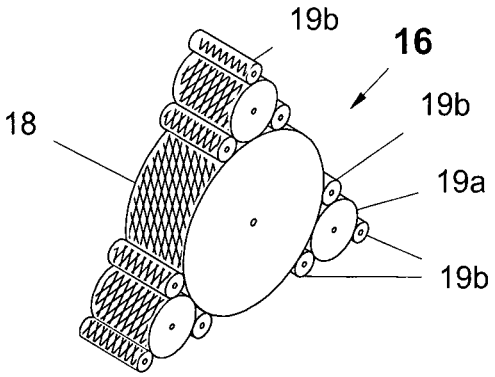
FIG. 12*b* shows a perspective view of a triangularly shaped end product of the invention prior to winding around it the mesh web being provided in the device of the invention.

FIG. 11*a* shows an exploded perspective view of a disc 12*a* of the mechanism 10 that provides the desirably configured end product 17 composed of the combination of mesh rolls of the expanded aluminium mesh. Disc 12*a* is provided with a plurality of through holes 13*a* adapted to receive a plurality of pins 13. An appropriate number and location of pins 13 is selectively employed for obtaining a desirably configured end product of the device of the invention. FIG. 11*a* shows a large central roll 18 that is adapted to be fitted onto the pin 13 located at the center of disc 12*a*, four intermediately sized peripheral rolls 19*a*, smaller than the aforementioned roll 18, which are being fitted at four pins 13 located around the circumference of the central roll 18, such four rolls 19*a* defining the four corners of a square and further eight even smaller peripheral rolls 19*b*, a pair of such smaller rolls 19*b* being mounted at a correspondingly spaced pair of pins on either side of each pin 13 adapted to receive the intermediately sized roll 19*a*. defining a corner of the square. As shown in FIG. 11*b*, a squarely shaped mesh roll assembly 16 is obtained and a squarely shaped end product 17 of the invention is obtained following winding of mesh web 15 around the roll assembly 16. Accordingly, the triangularly shaped mesh roll assembly 16 of FIG. 12*b* is obtained with disc 12*a* being provided with an appropriately designed locating and spacing of pins 13.

Furthermore, various exemplary mesh roll assembly products may be obtained as illustrated in FIGS. 13*a*-13*e*.

Figure 13A:
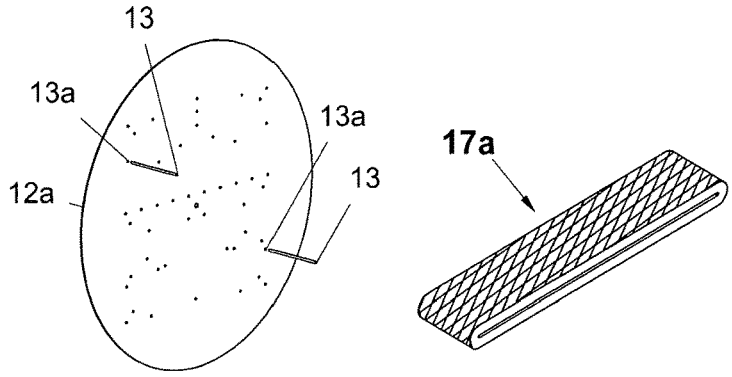
FIGS. 13*a*-13*e* show perspective views of a disc of the mechanism of FIGS. 10*a*, 10*b* with an array of selectively employed pins mounted thereupon with a scope of producing the mesh roll assembly being configured in the shape depicted adjacently to the disc.

By way of example, an elongate planar mesh item 17*a* as shown in FIG. 13*a* may be produced with a pair of pins 13 spaced at a distance corresponding to the length of mesh item 17*a* on the surface of the adjacently shown disc 12*a*.

Figure 13B:
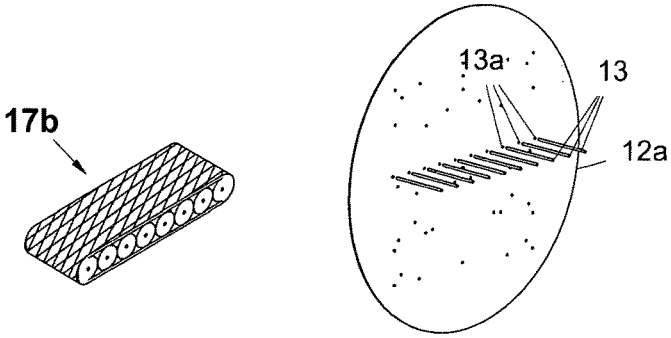

According to another example shown in FIG. 13*b*, a series of small sized rolls 19*b* may be mounted onto a series of appropriately spaced pins 13 onto the surface of adjacently shown disc 12*a*, such serial roll assembly being thereafter wound with mesh web 15 to produce the depicted end product of an elongate parallelepipedal item 17*b*.

Figure 13C:
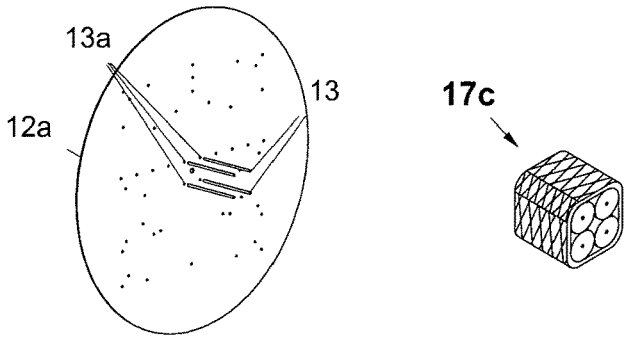

According to yet another example shown in FIG. 13*c*, four small sized rolls 19*b* may be mounted onto a squarely configured arrangement of pins 13 onto the surface of adjacently shown disc 12*a*, such squarely configured roll assembly being thereafter wound with mesh web 15 to produce the depicted end product of a small square item 17*c*.

Figure 13D:
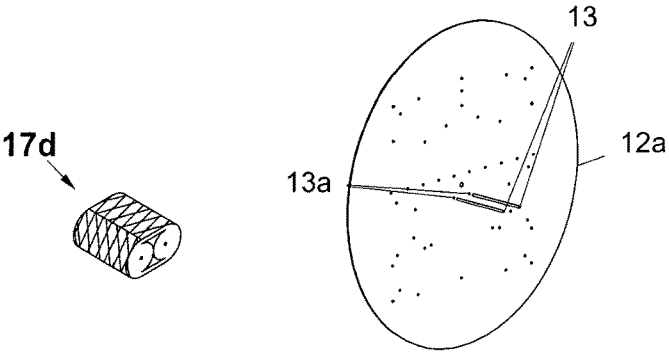

According to yet another example shown in FIG. 13*d*, a pair of small sized rolls 19*b* may be mounted onto a pair of correspondingly spaced arrangement pair of pins 13 onto the surface of adjacently shown disc 12*a*, such pair of rolls being thereafter wound with mesh web 15 to produce the depicted end product of a small elliptical item 17*d*.

Figure 13E:
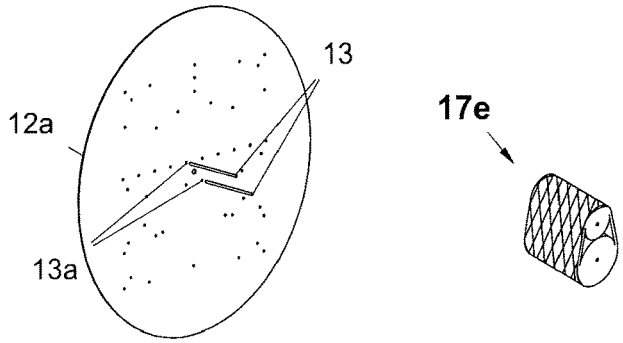

Another example presented in FIG. 13*e* produces an end product 17*e* consisting of a pair of unequally sized rolls wound with the mesh web provided in the device of the invention.

An inexhaustible variety of end product configurations may be produced with the device of the invention to serve the scope of maximally filling a fuel container.

The employment of four discs 12*a*-12*d* at each one of the four sides of the rotatable table 11*a* of the mechanism 10 adapted to provide the desirably configured end product 17 enables obtaining a maximal productivity by speeding up the process of setting up a desirably configured roll assembly and at the same time carrying out a process of winding a predetermined number of turns of the mesh web 15 provided by the device of the invention around this roll assembly 16 and eventually delivering a ready made final product 17.

Figure 10A:
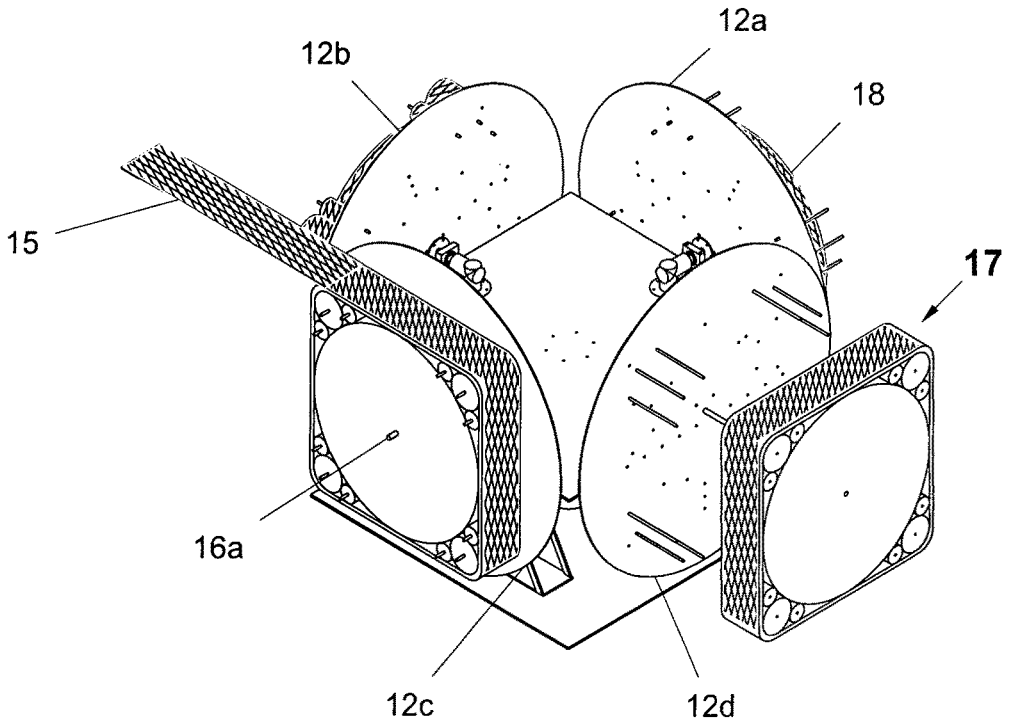
FIGS. 10*a* and 10*b* show successive phases of operation of the assembled mechanism of FIG. 9 further provided with a disc at each side of a rotatable square platform of this mechanism, each disc being adapted to provide the means of sequentially setting up a desirably configured mesh roll assembly and winding the mesh web around this mesh roll assembly to provide an end product of the device of the invention.
Figure 10B:
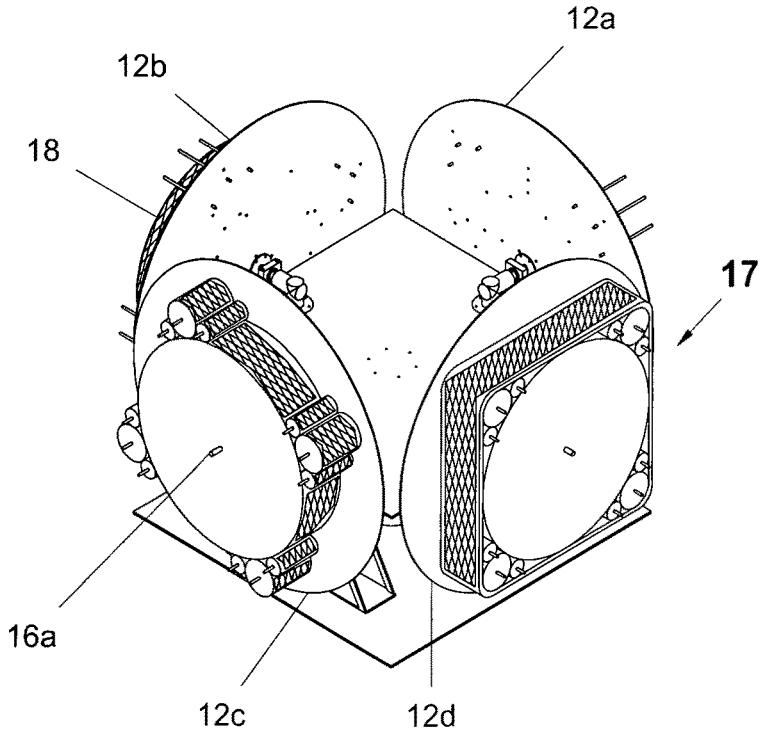

Following completion of a first step of mounting a necessary number of pins 13 onto each one of the discs 12*a*-12*d*, such pins being spaced in accordance with a specified predetermined design of the item to be produced and collection of a supply of appropriately sized rolls for the production of a specified number of end items, as seen in FIG. 10*a*, the following processes can be simultaneously carried out in mechanism 10 of the device of the invention:

a. Placement of a first number of roll components onto the disc 12*a*. By way of example the central roll 18 of the squarely or triangularly configured item of FIG. 11*b* or FIG. 12*b* respectively may be mounted onto disc 12*a*.

b. Placement of a second number of roll components onto the disc 12*b* to complete the desirably configured roll assembly. By way of example the peripheral rolls 19*a*, 19*b* of the squarely or triangularly configured item of FIG. 11*b* or FIG. 12*b* respectively may be mounted onto disc 12*b*.

c. Winding of the appropriately configured mesh roll assembly 16 mounted onto disc 12*c* with the mesh web 15 provided by the device of the invention, and d. Removal of the delivered ready made product from disc 12*d*.

Each time an operational cycle is completed with the simultaneous performance of the four hereinabove described four processes, the upper table 11*a* of mechanism 10 is rotated by an angle of 90° so that the empty disc 12*d* is brought at the position previously occupied by disc 12*a* and the subsequent discs also proceed a forward step of an equivalent angle of 90° so that a new operational cycle begins and the production process continues until a desired predetermined number of end items configured in a specific desired shape is obtained.

Figure 14B:
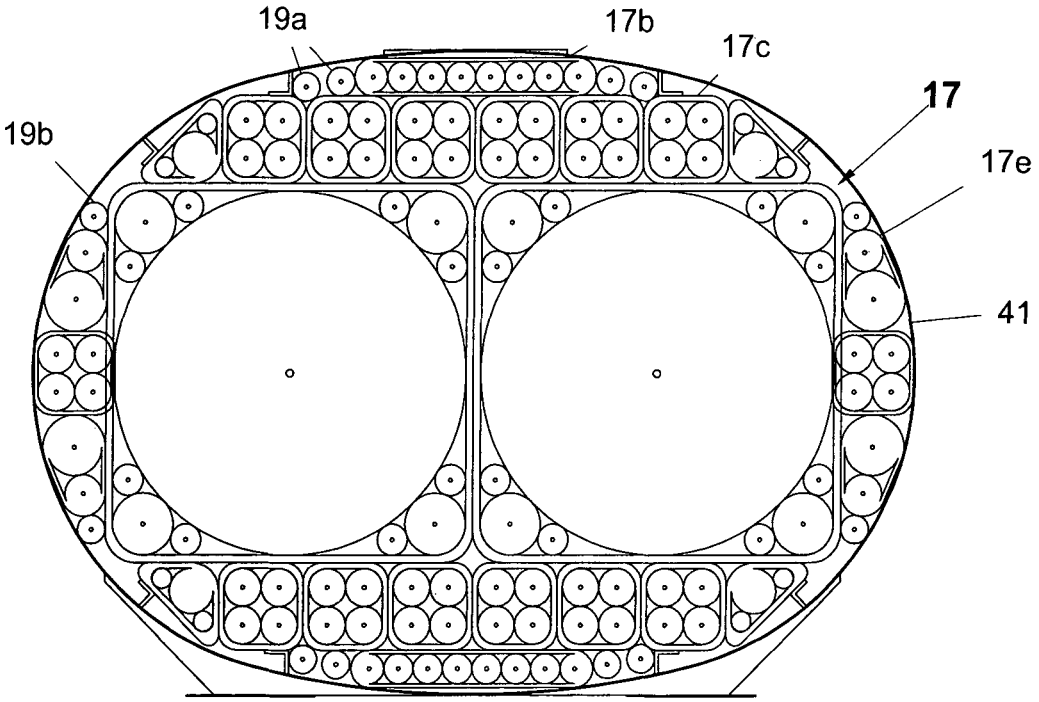
FIG. 14*a* shows a standardized type of a fuel tank filled with an appropriate combination of the expanded aluminium mesh roll assembly products of the device of the invention and FIG. 14*b* shows an illustrative transverse sectional view of the fuel tank displaying the filling thereof with the aforementioned expanded aluminium mesh roll assembly products.
Figure 14A:
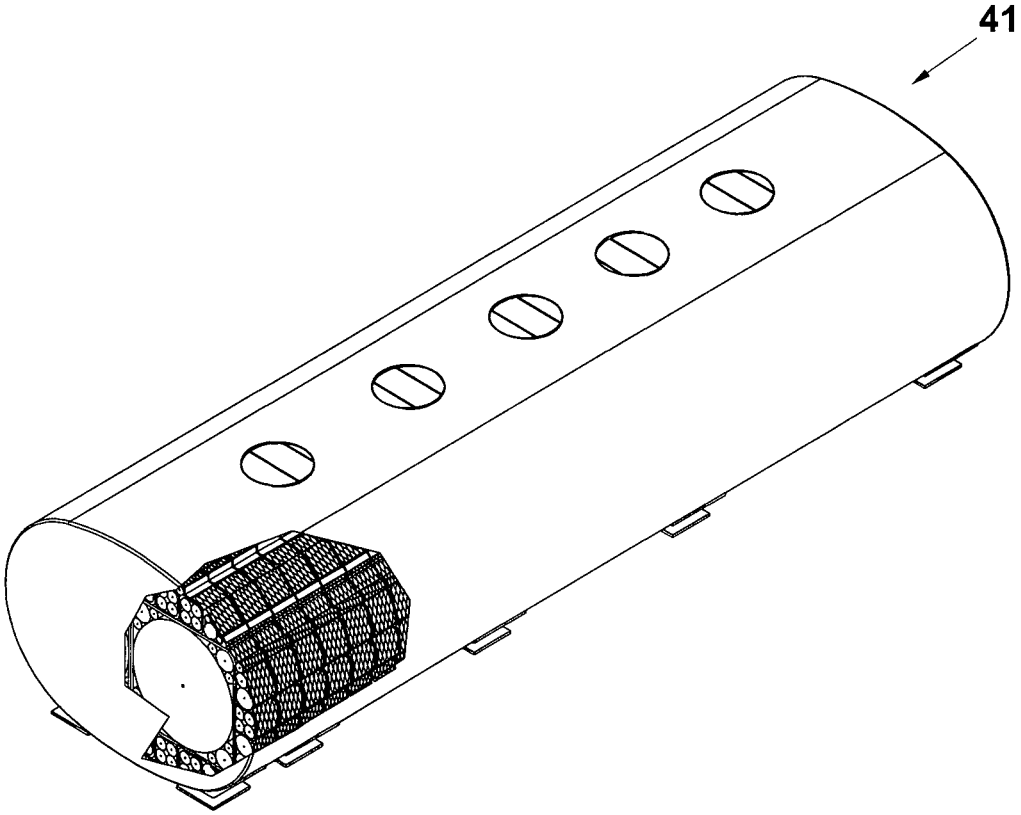
Figure 15B:
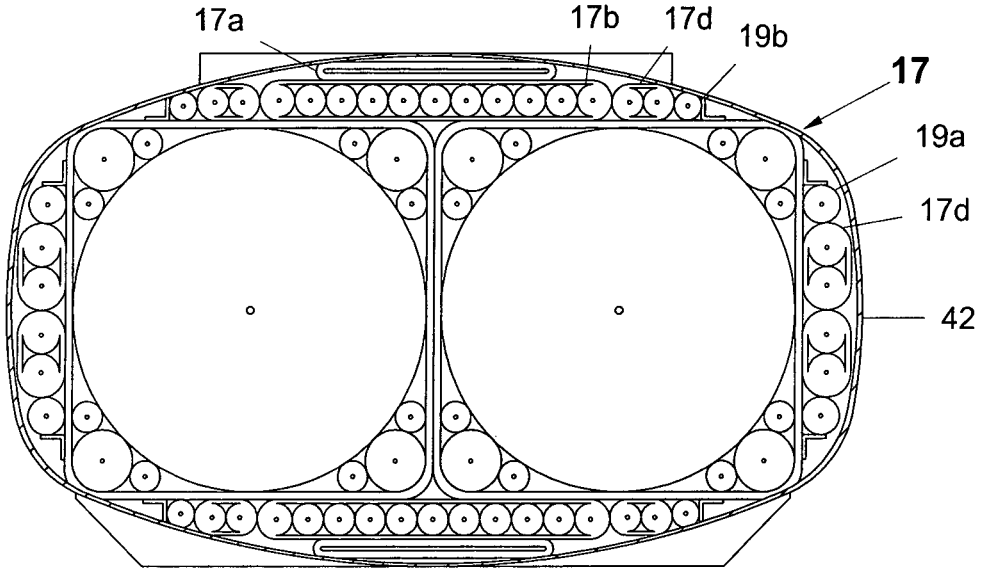
FIG. 15*a* shows another standardized type of a fuel tank filled with an appropriate combination of the expanded aluminium mesh roll assembly products of the device of the invention and FIG. 15*b* shows an illustrative transverse sectional view of the fuel tank displaying the filling thereof with the aforementioned expanded aluminium mesh roll assembly products.
Figure 15A:
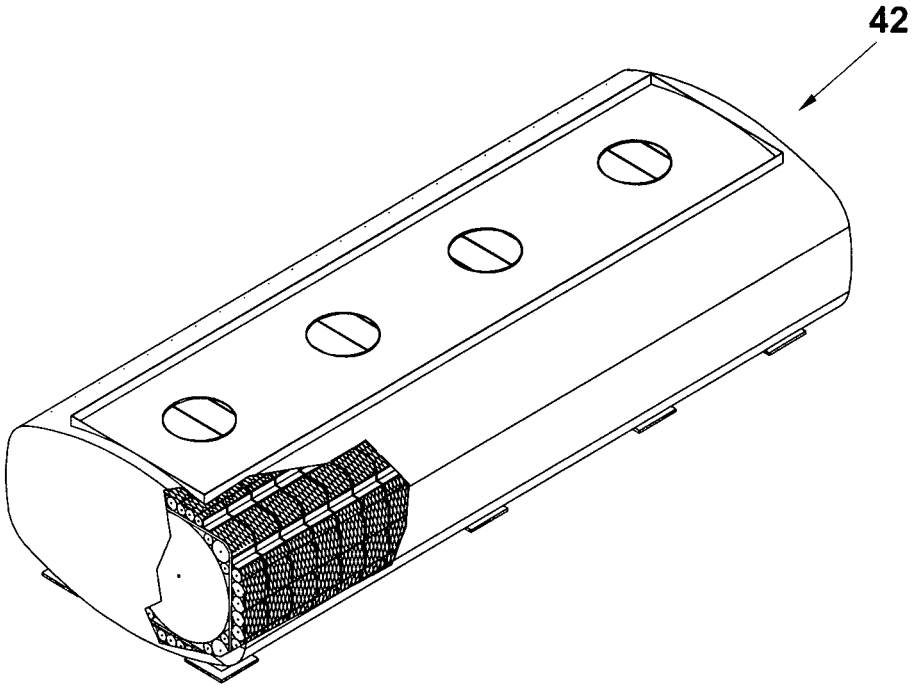
Figure 16:
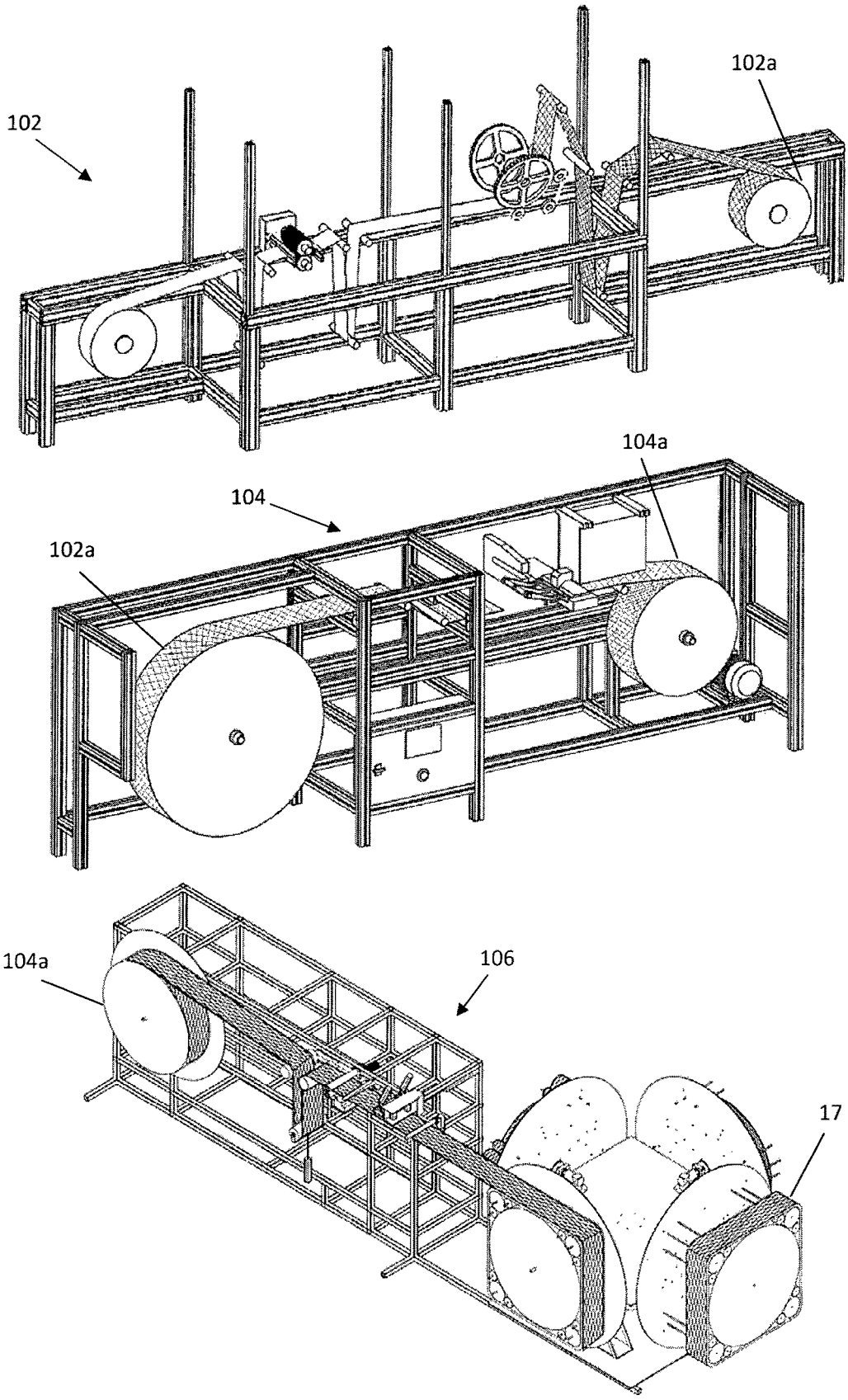
FIG. 16 shows an integrated system for the production and appropriate forming of expanded aluminium roll assemblies adapted to fill containers used for the storage and transport of fuels.

The object of the invention is to provide a variety of configurations of roll assemblies so as to obtain a maximally efficient filling of fuel containers. By way of example, FIGS. 14*a* and 15*a* depict standardized types of a fuel tank 41 and 42 respectively, which are being filled with an appropriate combination of the expanded aluminium mesh roll assembly products of the device of the invention with a scope to provide suppression of ignition and combustion of the fuel contained therein. FIGS. 14*b* and 15*b* accordingly show an illustrative transverse sectional view of fuel tanks 41 and 42 respectively displaying the filling thereof with the aforementioned expanded aluminium mesh roll assembly products of the invention.

In particular, as shown in FIG. 14*b*, fuel tank 41 is filled with a pair of adjacently mounted squarely shaped mesh roll assembly products 17 and a variety of other mesh roll assembly products including the hereinabove described products 17*b*, 17*c*, 17*c* and independent rolls of larger and smaller diameter 19*a* and 19*b* are used to fill the perimeter around the pair of adjacently mounted squarely shaped mesh roll assembly products 17. Further in FIG. 15*b* fuel tank 42 is also filled with a pair of adjacently mounted squarely shaped mesh roll assembly products 17, whilst the variety of other mesh roll assembly products used to fill the perimeter around the pair of adjacently mounted squarely shaped mesh roll assembly products 17 includes the hereinabove described products 17*a*, 17*b*, 17*d* and arrays of independent rolls 19*a*.

It is estimated that the employment in each particular instance of an appropriate combination of the variously configured mesh roll assembly products of the invention will provide an efficient filling of fuel tanks of all kinds at a percentage exceeding 90% of the volume thereof, thereby providing an enhanced effect of suppression of ignition and combustion of the fuel contained therein.

The invention claimed is:

1. Device for the production of selectively configured roll assemblies of expanded aluminium mesh adapted to efficiently fill fuel containers, said device sequentially comprising:

a roll (1) of expanded aluminium mesh at an inlet of the device;

a mechanism (5) adapted to provide tensioning of a mesh web (15) flowing from said inlet to an outlet of the device;

a mechanism (6) adapted to provide a forward movement of said mesh web (15);

a mechanism (7) adapted to transversely cut a predetermined portion of said mesh web (15);

a mechanism (8) adapted to securely fold the edge of the transversely cut end of said mesh web (15);

at least one arrangement of guiding rollers (9) of said mesh web (15); and a mechanism (10) adapted to provide setting up a desirably configured mesh roll assembly (16) and winding said mesh web (15) around said mesh roll assembly (16) to provide an end product of a variety of selectively configured roll assemblies (17) of expanded aluminium mesh adapted to efficiently fill fuel containers, wherein said mesh roll assembly (16) is mounted onto a rotatable disc (12*c*) of said mechanism (10);

an end of said mesh web (15) derived from said roll (1) at the inlet of the device is stapled along a transverse line of stapling (29) onto said mesh roll assembly (16);

said mechanism (6) being adapted to be initiated immediately after said mechanism (7) transversely cuts a predetermined portion of said mesh web (15) and to be terminated as soon as the end of said mesh web (15) is stapled along a transverse line of stapling (29) onto said mesh roll assembly (16), and said rotatable disc (12*c*) of said mechanism (10) being adapted to rotate immediately after said end of said mesh web (15) is stapled along a transverse line of stapling (29) onto said mesh roll assembly (16) and being adapted to stop following completion of a predetermined number of turns of said mesh web (15) around said mesh roll assembly (16);

wherein said mechanism (10) adapted to provide setting up a desirably configured mesh roll assembly (16) and winding said mesh web (15) around said mesh roll assembly (16) to provide an end product of a variety of selectively configured roll assemblies (17) of expanded aluminium mesh for efficiently filling fuel containers comprises:

a fixed lower table (11*b*) and an upper rotatable table (11*a*), said upper rotatable table (11*a*) being pivotally supported by said fixed lower table (lib) and being provided with an angularly configured motion transmission mechanism (50) mounted proximally to an edge medially along each one of four sides thereof;

one of four vertically oriented discs (12*a*, 12*b*, 12*c*, 12*d*) being connected to a respective said angularly configured motion transmission mechanism (50);

a motor (31*a*) fixedly mounted onto said fixed lower table (11*b*) and providing rotational strokes of 90° of said upper rotatable table (11*a*);

a motor (31*b*) fixedly mounted onto said fixed lower table (11*b*) and providing rotation of one of said angularly configured motion transmission mechanisms (50); and each of said four vertically oriented discs (12*a*, 12*b*, 12*c*, 12*d*) being provided with a plurality of holes (13*a*) adapted to receive a plurality pins (13) spaced in accordance with a design appropriate for the production of a desirably configured mesh roll assembly (16), each of said pins (13) being adapted to receive a mesh roll component (18, 19*a*, 19*b*) of said desirably configured mesh roll assembly (16), one of said four vertically oriented discs (12*a*, 12*b*, 12*c*, 12*d*) being provided with said desirably configured mesh roll assembly (16) being adapted to rotate in each operational cycle of said device for winding a predetermined number of turns of said mesh web (15) around said desirably configured mesh roll assembly (16) to produce an end product of roll assemblies (17) of expanded aluminium mesh for efficiently filling fuel containers.

2. The device of claim 1 wherein said mechanism (5) adapted to provide tensioning of the mesh web (15) flowing from said inlet to said outlet of the device comprises:

a pair of rollers (2, 4); and a tensioning roller (3), said rollers (2, 4) spaced apart at a distance that corresponds to the diameter of said tensioning roller (3), said tensioning roller (3) being mounted within a socket being formed by said mesh web (15) being sunk downwardly in between said rollers (2, 4), said tensioning roller (3) being adapted to slide vertically within said socket thereby downwardly pulling said mesh web (15) and ensuring a steady predetermined tension thereof.

3. The device of claim 1 wherein said mechanism (6) adapted to provide a forward movement of mesh web (15) comprises:

a pair of equally sized rollers (6*a*, 6*b*) oriented in parallel, below and above the mesh web (15) respectively;

a fixedly mounted base (27) provided at one side of said roller (6*a*) with pillars (27*a*) extending upwardly; and a reciprocating base (26) provided at one side of said roller (6*b*) supported by said pillars (27*a*), a centrally extending shaft of roller (6*a*) passing through said base (27) connected to a drive gear (25*a*) being driven by a motor (28) and a centrally extending shaft of roller (6*b*) passing through said base (26) connected to a gear (25*b*), said reciprocating base (26) being adapted to alternatively provide engagement of said gear (25*b*) with said drive gear (25*a*) thereby initiating through activation of said motor (28) a forward stroke of said mesh web (15) flowing in between said rollers (6*a*, 6*b*) or disengagement of said gear (25*b*) from said drive gear (25*a*) thereby allowing free passage of said mesh web (15) flowing in between said rollers (6*a*, 6*b*).

4. The device of claim 1 wherein said mechanism (7) adapted to transversely cut said mesh web (15) comprises:

a fixedly mounted base member (7*a*) mounted underneath said mesh web (15); and a cutting blade (7*b*) arranged above said base member (7*a*) overlying the mesh web (15) and adapted to move downwardly during a cutting operation to be brought in abutment with said base (7*a*) and perform transverse cutting of the mesh web (15) contained therebetween.

5. The device of claim 1 wherein said mechanism (8) adapted to securely fold the edge of a cut end of said mesh web (15) that is provided downstream of said mechanism (7) comprises:

a parallelepipedal block member with an upper base (80), a lower base (82) and a lateral base (87) interconnecting said upper base (80) and said lower base (82);

a pneumatic cylinder-piston arrangement (86, 86*a*) provided at one narrow side of the parallelepipedal block;

a plate (84) having dimensions equivalent to those of the lower base (82) being moved by said cylinder-piston arrangement (86, 86*a*) to be brought underneath said lower base (82) whereby said mesh web (15) abuts an upper surface of said plate (84);

a plate (85) having dimensions equivalent to those of the lower base (82) being pivotally mounted onto said lateral base (87);

a pair of pneumatic cylinders (83) being adapted to perform a rotational stroke of said plate (85) and bring it in a position underlying said plate (84) following a cutting operation of said mesh web (15) and arranging an end portion of said mesh web (15) to abut a bottom surface of said plate (84); and a pair of vertically oriented pneumatic cylinders (81) being adapted to provide a downward movement of said lower base (82) and exert pressure onto said plate (84) lying in between the lower base (82) and the plate (85) thereby resulting in providing a folded edge of said mesh web, said pneumatic cylinder-piston arrangement (86, 86*a*) being adapted to perform a rearward linear movement to remove said plate (84) and said pneumatic cylinders (83) being adapted to perform a return rotational stroke of said plate (85), whereby said mechanism (8) returns at an idle condition, ready to accept and securely fold the edge of a new mesh web portion (15).

6. The device of claim 1, wherein said mechanism (10) adapted to provide setting up a desirably configured mesh roll assembly (16) and winding said mesh web (15) around said mesh roll assembly (16) is adapted to selectively provide among others an end product of a squarely or triangularly configured mesh item (17) containing appropriately spaced mesh rolls (18, 19*a*, 19*b*), an elongate planar mesh item (17*a*), an elongate parallelepipedal mesh item (17*b*) containing a series of small sized mesh rolls (19*b*), a small square mesh item (17*c*) containing four small sized rolls (19*b*), an elliptical item (17*d*) comprising a pair of small sized rolls (19*b*) and an end product (17*e*) consisting of a pair of unequally sized rolls (19*a*, 19*b*).

7. Method of production of end items of selectively configured roll assemblies (17) of expanded aluminium mesh for efficiently filling fuel containers using the device of claim 1 comprising the steps of:

mounting a necessary number of said pins (13) onto each one of said discs (12*a*, 12*b*, 12*c*, 12*d*), said pins (13) being spaced in accordance with a specified predetermined design of an end item to be produced and collection of a supply of appropriately sized rolls (18, 19*a*, 19*b*) for the production of a specified number of end items, and simultaneously implementing the steps of a. Placement of a first number of roll components onto a first number of pins (13) of disc (12*a*);

b. Placement of a second number of roll components onto a second number of pins (13) of disc (12*b*) to complete a desirably configured mesh roll assembly (16);

c. Mounting said desirably configured mesh roll assembly (16) onto disc (12*c*) and winding around the same of a predetermined number of turns of said mesh web (15);

d. Delivery of a ready made end item of selectively configured roll assembly (17) of expanded aluminium mesh from disc (12*d*);

wherein following completion of said simultaneously performed steps, said upper table (11*a*) of said mechanism (10) is rotated by an angle of 90° so that the emptied disc (12*d*) is brought at the position previously occupied by disc (12*a*), the subsequent discs (12*a*, 12*b*, 12*c*) also proceeding a forward step of an equivalent angle of 90° and a new operational cycle begins with the production continued until a desired predetermined number of end items configured in said specified predetermined design is obtained.

8. System of production of selectively configured roll assemblies of expanded aluminium mesh adapted to efficiently fill fuel containers comprising in combination:

a first machine (102) employed to produce a first roll (102*a*) of an expanded aluminum mesh adapted to fill fuel containers and provide suppression of ignition and combustion of the fuel contained therein;

a second unreeling-rereeling machine (104) employed to be supplied with said first roll (102*a*) of expanded aluminum mesh and adapted to produce second rolls (104*a*) of selectively defined smaller diameters and a third machine (106) employed to be supplied with said second rolls (104*a*) of selectively defined smaller diameters of expanded aluminum mesh and adapted to form selectively configured roll assemblies (17) of expanded aluminium mesh, wherein an appropriate combination of said selectively configured roll assemblies (17) of expanded aluminium mesh is employed for efficiently filling fuel containers of varying dimensions and configurations to provide suppression of ignition and combustion of the fuel contained therein, wherein said third machine (106) is the device of claim 1.

9. Device for the production of selectively configured roll assemblies of expanded aluminium mesh adapted to efficiently fill fuel containers, said device sequentially comprising:

a roll (1) of expanded aluminium mesh at an inlet of the device;

a mechanism (5) adapted to provide tensioning of a mesh web (15) flowing from said inlet to an outlet of the device;

a mechanism (6) adapted to provide a forward movement of said mesh web (15);

a mechanism (7) adapted to transversely cut a predetermined portion of said mesh web (15);

a mechanism (8) adapted to securely fold the edge of the transversely cut end of said mesh web (15);

at least one arrangement of guiding rollers (9) of said mesh web (15); and a mechanism (10) adapted to provide setting up a desirably configured mesh roll assembly (16) and winding said mesh web (15) around said mesh roll assembly (16) to provide an end product of a variety of selectively configured roll assemblies (17) of expanded aluminium mesh adapted to efficiently fill fuel containers, wherein said mesh roll assembly (16) is mounted onto a rotatable disc (12*c*) of said mechanism (10);

an end of said mesh web (15) derived from said roll (1) at the inlet of the device is stapled along a transverse line of stapling (29) onto said mesh roll assembly (16);

said mechanism (6) being adapted to be initiated immediately after said mechanism (7) transversely cuts a predetermined portion of said mesh web (15) and to be terminated as soon as the end of said mesh web (15) is stapled along a transverse line of stapling (29) onto said mesh roll assembly (16), and said rotatable disc (12*c*) of said mechanism (10) being adapted to rotate immediately after said end of said mesh web (15) is stapled along a transverse line of stapling (29) onto said mesh roll assembly (16) and being adapted to stop following completion of a predetermined number of turns of said mesh web (15) around said mesh roll assembly (16);

wherein said mechanism (6) adapted to provide a forward movement of mesh web (15) comprises:

a pair of equally sized rollers (6*a*, 6*b*) oriented in parallel, below and above the mesh web (15) respectively;

a fixedly mounted base (27) provided at one side of said roller (6*a*) with pillars (27*a*) extending upwardly; and a reciprocating base (26) provided at one side of said roller (6*b*) supported by said pillars (27*a*), a centrally extending shaft of roller (6*a*) passing through said base (27) connected to a drive gear (25*a*) being driven by a motor (28) and a centrally extending shaft of roller (6*b*) passing through said base (26) connected to a gear (25*b*), said reciprocating base (26) being adapted to alternatively provide engagement of said gear (25*b*) with said drive gear (25*a*) thereby initiating through activation of said motor (28) a forward stroke of said mesh web (15) flowing in between said rollers (6*a*, 6*b*) or disengagement of said gear (25*b*) from said drive gear (25*a*) thereby allowing free passage of said mesh web (15) flowing in between said rollers (6*a*, 6*b*).

10. Device for the production of selectively configured roll assemblies of expanded aluminium mesh adapted to efficiently fill fuel containers, said device sequentially comprising:

a roll (1) of expanded aluminium mesh at an inlet of the device;

a mechanism (5) adapted to provide tensioning of a mesh web (15) flowing from said inlet to an outlet of the device;

a mechanism (6) adapted to provide a forward movement of said mesh web (15);

a mechanism (7) adapted to transversely cut a predetermined portion of said mesh web (15);

a mechanism (8) adapted to securely fold the edge of the transversely cut end of said mesh web (15);

at least one arrangement of guiding rollers (9) of said mesh web (15);

a mechanism (10) adapted to provide setting up a desirably configured mesh roll assembly (16) and winding said mesh web (15) around said mesh roll assembly (16) to provide an end product of a variety of selectively configured roll assemblies (17) of expanded aluminium mesh adapted to efficiently fill fuel containers, wherein said mesh roll assembly (16) is mounted onto a rotatable disc (12*c*) of said mechanism (10);

an end of said mesh web (15) derived from said roll (1) at the inlet of the device is stapled along a transverse line of stapling (29) onto said mesh roll assembly (16);

said mechanism (6) being adapted to be initiated immediately after said mechanism (7) transversely cuts a predetermined portion of said mesh web (15) and to be terminated as soon as the end of said mesh web (15) is stapled along a transverse line of stapling (29) onto said mesh roll assembly (16), and said rotatable disc (12*c*) of said mechanism (10) being adapted to rotate immediately after said end of said mesh web (15) is stapled along a transverse line of stapling (29) onto said mesh roll assembly (16) and being adapted to stop following completion of a predetermined number of turns of said mesh web (15) around said mesh roll assembly (16);

wherein said mechanism (8) adapted to securely fold the edge of a cut end of said mesh web (15) that is provided downstream of said mechanism (7) comprises:

a parallelepipedal block member with an upper base (80), a lower base (82) and a lateral base (87) interconnecting said upper base (80) and said lower base (82);

a pneumatic cylinder-piston arrangement (86, 86*a*) provided at one narrow side of the parallelepipedal block;

a plate (84) having dimensions equivalent to those of the lower base (82) being moved by said cylinder-piston arrangement (86, 86*a*) to be brought underneath said lower base (82) whereby said mesh web (15) abuts an upper surface of said plate (84);

a plate (85) having dimensions equivalent to those of the lower base (82) being pivotally mounted onto said lateral base (87);

a pair of pneumatic cylinders (83) being adapted to perform a rotational stroke of said plate (85) and bring it in a position underlying said plate (84) following a cutting operation of said mesh web (15) and arranging an end portion of said mesh web (15) to abut a bottom surface of said plate (84); and a pair of vertically oriented pneumatic cylinders (81) being adapted to provide a downward movement of said lower base (82) and exert pressure onto said plate (84) lying in between the lower base (82) and the plate (85) thereby resulting in providing a folded edge of said mesh web, said pneumatic cylinder-piston arrangement (86, 86*a*) being adapted to perform a rearward linear movement to remove said plate (84) and said pneumatic cylinders (83) being adapted to perform a return rotational stroke of said plate (85), whereby said mechanism (8) returns at an idle condition, ready to accept and securely fold the edge of a new mesh web portion (15).

* * * * *